US007256763B2

(12) United States Patent
Kaneki et al.

(10) Patent No.: US 7,256,763 B2
(45) Date of Patent: Aug. 14, 2007

(54) LIQUID CRYSTAL DISPLAY DEVICE AND DRIVING METHOD THEREOF

(75) Inventors: Takeshi Kaneki, Mobara (JP); Mutsumi Maehara, Mobara (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 603 days.

(21) Appl. No.: 10/864,646

(22) Filed: Jun. 10, 2004

(65) Prior Publication Data

US 2004/0252097 A1 Dec. 16, 2004

(30) Foreign Application Priority Data

Jun. 10, 2003 (JP) ..... 2003-165157

(51) Int. Cl.
*G09G 3/36* (2006.01)

(52) U.S. Cl. ..... 345/102; 345/87; 345/204

(58) Field of Classification Search ..... 345/87, 345/102, 204, 98–100
See application file for complete search history.

(56) References Cited

U.S. PATENT DOCUMENTS

| | | | | |
|---|---|---|---|---|
| 5,912,651 | A | 6/1999 | Bitzakidis et al. | |
| 6,396,469 | B1 | 5/2002 | Miwa et al. | |
| 7,113,163 | B2 * | 9/2006 | Nitta et al. | 345/102 |
| 7,133,037 | B2 * | 11/2006 | Kim et al. | 345/206 |
| 2002/0057238 | A1 * | 5/2002 | Nitta et al. | 345/87 |
| 2002/0057241 | A1 * | 5/2002 | Oda et al. | 345/87 |
| 2002/0070914 | A1 * | 6/2002 | Bruning et al. | 345/102 |
| 2002/0084973 | A1 * | 7/2002 | Choi et al. | 345/102 |
| 2002/0093480 | A1 * | 7/2002 | Mizutani et al. | 345/102 |
| 2002/0149576 | A1 * | 10/2002 | Tanaka et al. | 345/204 |
| 2003/0169247 | A1 * | 9/2003 | Kawabe et al. | 345/204 |
| 2004/0001054 | A1 | 1/2004 | Nitta et al. | |
| 2006/0050047 | A1 * | 3/2006 | Jin et al. | 345/102 |

FOREIGN PATENT DOCUMENTS

| | | |
|---|---|---|
| JP | 11-109921 | 4/1999 |
| JP | 2001-204049 | 7/2001 |
| JP | 2003-280599 | 10/2003 |

* cited by examiner

*Primary Examiner*—Richard Hjerpe
*Assistant Examiner*—Kimnhung Nguyen
(74) *Attorney, Agent, or Firm*—Antonelli, Terry, Stout & Kraus, LLP.

(57) ABSTRACT

In a liquid crystal display and a method of driving the same, the liquid crystal display includes: a liquid crystal display panel having a matrix of a plurality of pixels arrayed two dimensionally in a first direction and in a second direction crossing the first direction; and an illuminating device including a plurality of light sources facing the pixel matrix of the liquid crystal display panel. The plurality of light sources are arrayed in the first direction and grouped into a plurality of light source areas. The turn-on start timing of light sources in each light source area is set to a specific timing based on the input timing of the video signal to the selected pixel rows in the pixel matrix. Further, the turn-on and turn-off timings of the light source areas are set to specific conditions.

15 Claims, 26 Drawing Sheets

MOVING IMAGE BLUR/BRIGHTNESS PROFILE

MOVING IMAGE BLUR DEFINITION

BEW[pixcl] : Blurred Edge Width

- WITHIN 10-90%

N-BEW[frame] : Normalized-BEW

- BEW/MOVING SPEED =pixel/(8 pixels/frame)

BRIGHTNESS RESPONSE WAVEFORM BEFORE AND AFTER BLACK INSERTION

MOTION PICTURE PERFORMANCE AND BRIGHTNESS DETERIORATION RATE FOR SIMULTANEOUS BLINK

ARROW: BLINK TIMING CHANGE DIRECTION IN UPPER AND LOWER AREA

SEQUENTIAL BLINK SYNCHRONIZED WITH DATA WRITE

LIGHT LEAKAGE TO MIDDLE AREA IS ADJUSTED

SPEC:
BLINK DUTY: CONSTANT (50%)
BLINK INTERVAL: CONSTANT
ON PERIODS OF UPPER AND LOWER AREAS NOT SEPARATED BY TIME GAP

SPEC:
BLINK DUTY: CONSTANT (50%)
BLINK INTERVAL: VARIABLE
ON PERIODS OF UPPER AND LOWER AREAS NOT SEPARATED BY TIME GAP

SPEC:
BLINK DUTY: INDIVIDUALLY DIFFERENT
BLINK INTERVAL: VARIABLE
ON PERIODS OF UPPER AND LOWER AREAS NOT SEPARATED BY TIME GAP

FIG. 14A

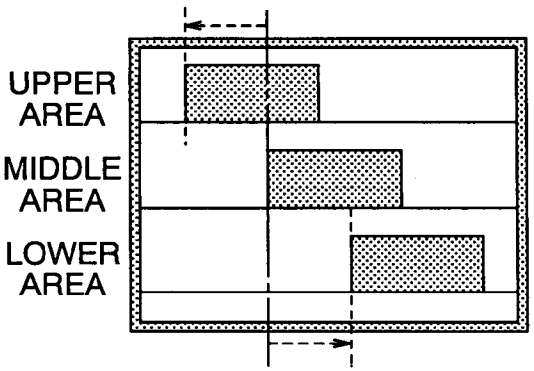

UPPER AND LOWER AREA BLINK TIMING CHANGE DIRECTION

WHEN DIVIDED INTO 3 AREAS

FIG. 14B

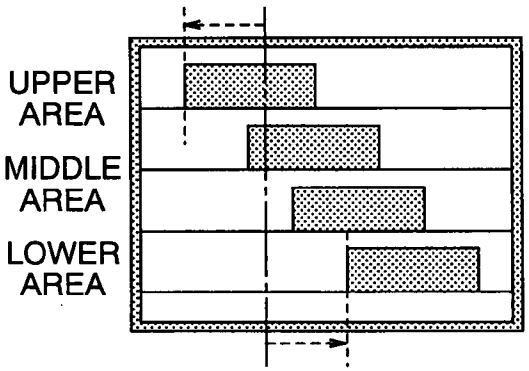

UPPER AND LOWER AREA BLINK TIMING CHANGE DIRECTION

WHEN DIVIDED INTO 4 AREAS

FIG. 14C

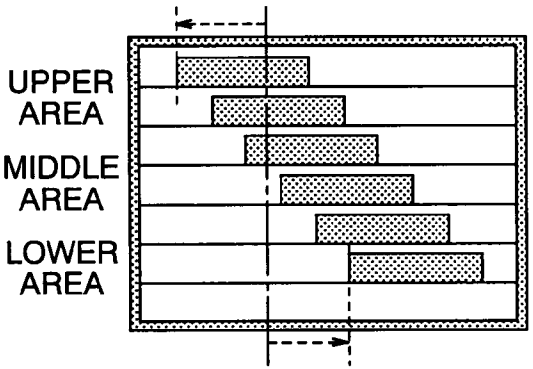

UPPER AND LOWER AREA BLINK TIMING CHANGE DIRECTION

WHEN DIVIDED INTO 6 AREAS

FOR 4- AND 6-AREA DIVISION, TOO, UPPERMOST AND LOWERMOST AREA BLINK TIMINGS ARE CHANGED BY TAKING SIMULTANEOUS BLINK TIMING AS REFERENCE MIDDLE AREA TIMING IS EVENLY ARRANGED BY TAKING UPPERMOST AND LOWERMOST AREA TIMINGS AS REFERENCE

LIQUID CRYSTAL DISPLAY DEVICE AND DRIVING METHOD THEREOF

BACKGROUND OF THE INVENTION

The present invention relates to a method of driving a liquid crystal display and more particularly to a liquid crystal display with an improved performance of displaying a moving image on, for instance, a liquid crystal television and a method of driving the liquid crystal display.

Liquid crystal television sets (hereinafter referred to as liquid crystal TVs) that use a TFT type liquid crystal display module as a display unit are available on the market.

This type of liquid crystal TV employs a display system in which a backlight is normally turned on (referred to as a hold type display system). The hold type display system is known to have a problem that a moving image displayed looks blurred.

As a measure to deal with this problem, it is known to insert black data between video frames (referred to as a black insertion display system) (U.S. Pat. No. 6,396,469).

A liquid crystal display wherein the backlight is intermittently turned on is disclosed in U.S. Pat. No. 5,912,651.

SUMMARY OF THE INVENTION

As a display size of liquid crystal TVs is becoming increasingly larger, there is a growing call for improved motion picture performance. In the black insertion display system, this demand can be met by increasing the amount of black data to be inserted.

In the above black insertion display system, however, increasing the black data insertion volume, although it improves the motion picture performance, but brings degrade the luminance performance.

Since the luminance performance is one of the most important characteristics of TVs, the black data insertion volume cannot be increased for fear of luminance deterioration. This means that in the black insertion display system a further improvement cannot be made of the motion picture performance according to an increase in the display size of the liquid crystal TVs.

The present invention has been accomplished to overcome the above problem experienced with the conventional technology and an object of this invention is to provide a method of driving a liquid crystal display which can further improve the motion picture performance.

In addition to the black insertion technique, the inventors of this invention studied a case in which a backlight is intermittently turned on (referred to as blinking) in one frame period. It has been found that the motion picture performance greatly varies depending on a timing of blinking.

This invention has been accomplished based on this finding and the representative one of inventions disclosed in this patent application may be briefly summarized as follows.

In one aspect, the present invention provides a liquid crystal display and a method of driving the same, wherein the liquid crystal display comprises a liquid crystal display panel and an illuminating device;

wherein the liquid crystal display panel has a matrix of a plurality of pixels arrayed two-dimensionally in a first direction and in a second direction crossing the first direction, and in the pixel matrix a plurality of pixel rows each made up of a group of pixels lined in the second direction are arrayed in the first direction and sequentially selected in each frame period from one end of the pixel matrix to the other end;

wherein the illuminating device has a plurality of light sources facing the pixel matrix of the liquid crystal display panel and the plurality of light sources are arrayed in the first direction and divided into at least three light source areas facing at least three groups of pixel rows;

wherein turn-on periods of the light source areas sequentially start in the each frame period when one of the at least three groups of pixel rows corresponding to the at least three light source areas is selected and the plurality of pixels belonging to the selected group of pixel rows begin to receive video signals;

wherein the turn-on periods of the light source areas sequentially ends in the each frame period;

wherein the at least three light source areas are a first light source area, a second light source area and a third light source area, the first light source area facing a middle area, with respect to the first direction, of the pixel matrix where a first group of the pixel rows is situated, the second light source area facing an area of the pixel matrix adjoining the middle area in the first direction where a second group of the pixel rows is situated which is selected before the first group of the pixel rows in the each frame period, the third light source area facing another area of the pixel matrix adjoining the middle area in the first direction where a third group of the pixel rows is situated which is selected after the first group of the pixel rows in the each frame period;

wherein the turn-on period of the second light source area, the turn-on period of the first light source area and the turn-on period of the third light source area are sequentially start and end in that order;

wherein the turn-on period of the second light source area ends after the turn-on period of the first light source area has started;

wherein the turn-on period of the third light source area starts after the turn-on period of the first light source area has started and when or before the turn-on period of the second light source area ends.

Other objects, features and advantages of the invention will become apparent from the following description of the embodiments of the invention taken in conjunction with the accompanying drawings.

BRIEF DESCRIPTION OF THE DRAWINGS

FIGS. 14A, 14B and 14C are diagrams showing a plurality of cold cathode fluorescent lamps as a direct-type backlight being divided into four and six parts.

DESCRIPTION OF THE EMBODIMENTS

Figure 1:
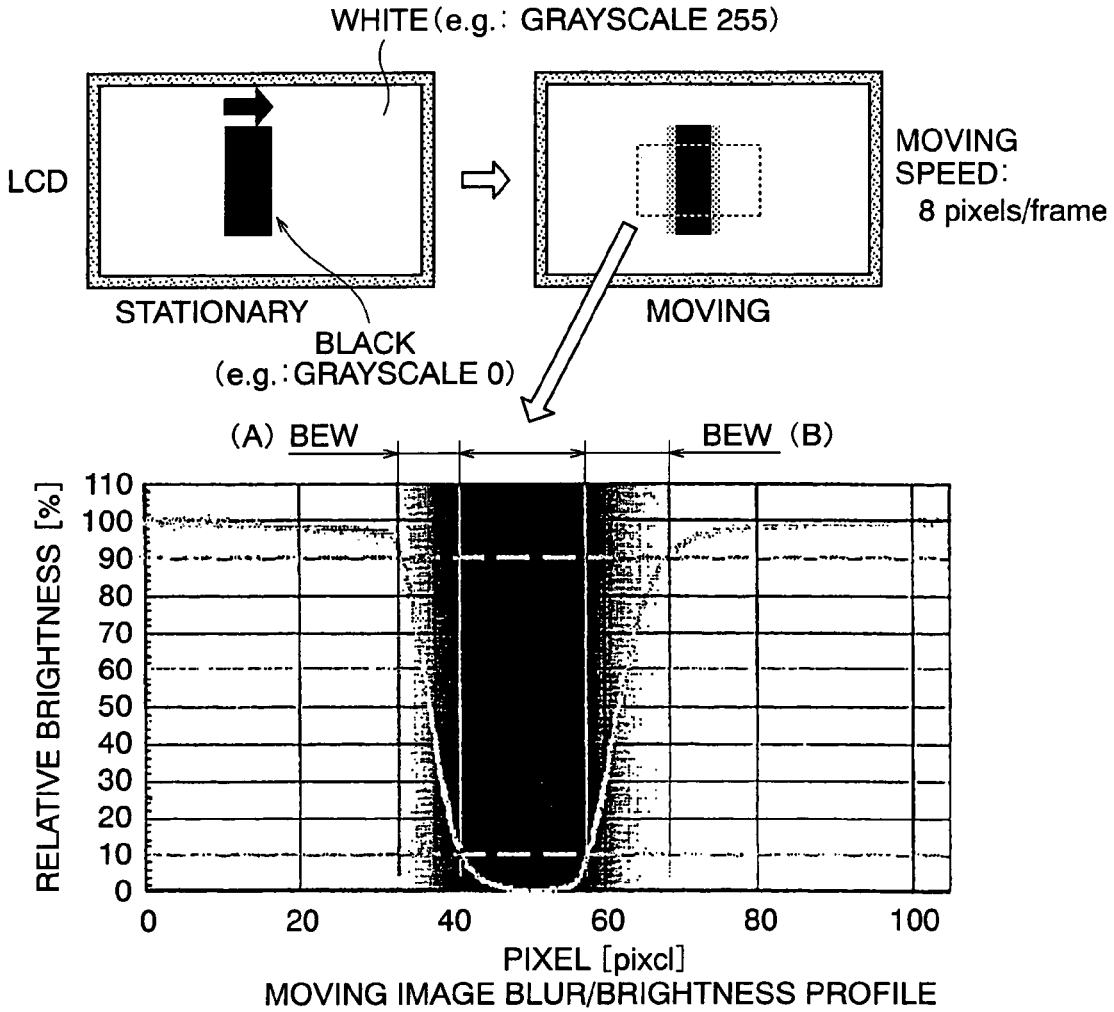
FIG. 1 is a diagram showing an index of a motion picture performance of the liquid crystal display.

Now, embodiments of this invention will be described in detail by referring to the accompanying drawings.

In all the figures showing embodiments of this invention, elements with identical functions are assigned like reference numerals and their repetitive explanations are omitted.

<Basic Configuration of Liquid Crystal Display Module Applying a Drive Method of This Embodiment>

Figure 16:
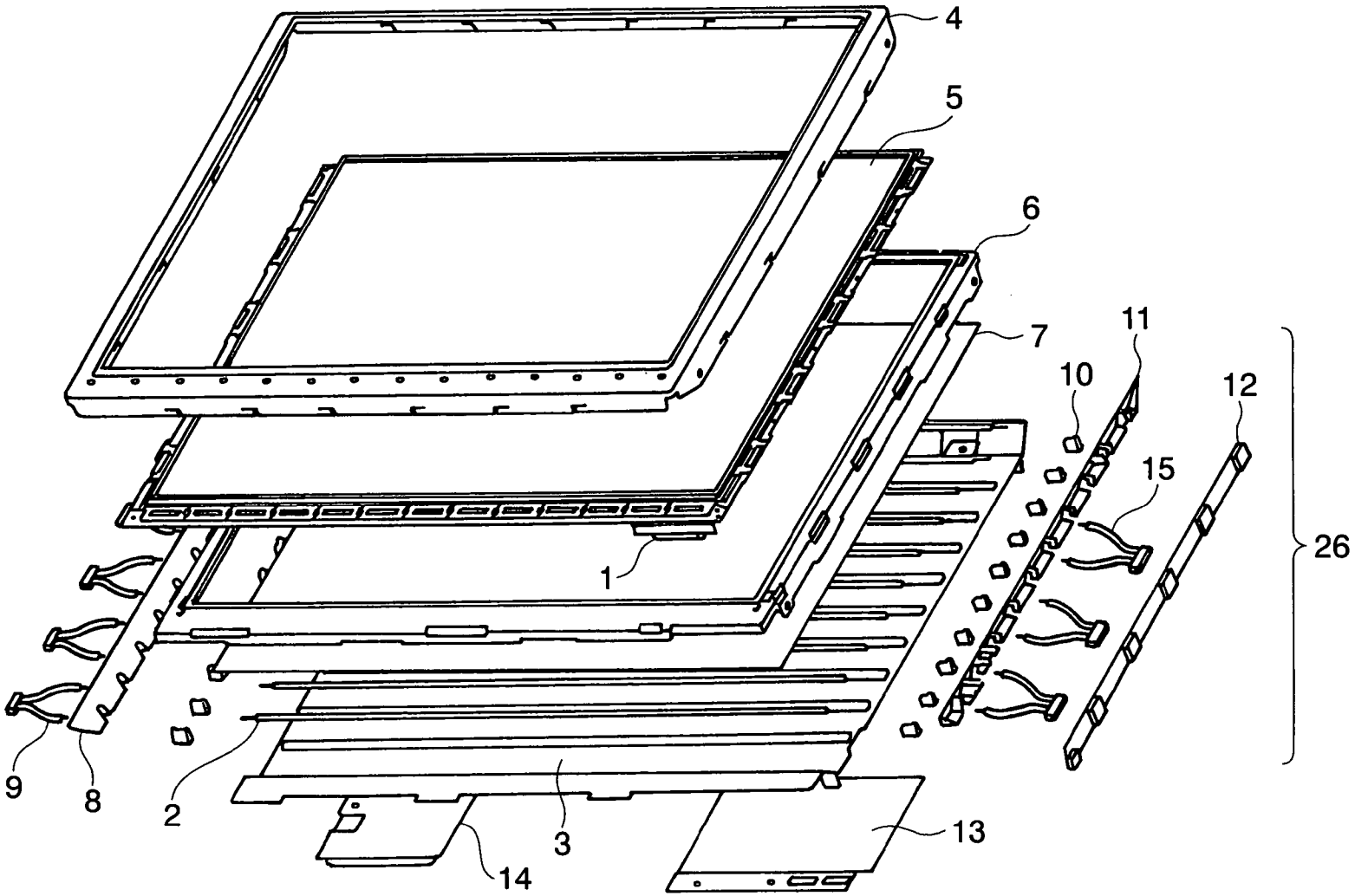
FIG. 16 is an exploded perspective view showing an outline construction of a liquid crystal display module that applies the method of driving the liquid crystal display of the embodiment of this invention.

FIG. 16 is an exploded perspective view showing an outline construction of a liquid crystal display module applying the drive method of this embodiment.

The liquid crystal display module of FIG. 16 comprises an upper frame 4 formed of a metal plate, a liquid crystal display panel 5, and a direct-type backlight unit.

The liquid crystal display panel 5 is constructed by stacking together a TFT substrate formed with pixel electrodes and thin-film transistors, and a filter substrate formed with counter electrodes and color filters, with a predetermined gap therebetween, bonding together the two substrates with a frame-like seal member provided around peripheral portions of and between the substrates, injecting a liquid crystal inside the seal member between the two substrates from a liquid crystal seal inlet provided in a part of the seal member, sealing the inlet, and bonding polarizing plates to the outsides of the two substrates.

On a glass substrate as the TFT substrate are mounted a plurality of drain drivers and gate drivers in the form of semiconductor integrated circuit (IC) devices.

The drain drivers are supplied a drive power, display data and a control signal through a flexible printed circuit board 1. The gate drivers are supplied a drive power and a control signal through the flexible printed circuit board 1.

The flexible printed circuit board 1 is connected to a drive circuit board (TCON board) 13 provided on a back side of the backlight unit.

The backlight unit of the liquid crystal display module of this embodiment has a plurality of cold cathode fluorescent lamps (CFL) 2 and optical members (diffusion sheet and lens sheet) 7 arranged between an intermediate frame 6 formed of a metal plate and a reflector 3 in the order shown in FIG. 16.

In FIG. 16, reference numbers 8 and 11 represent lamp holders for the cold cathode fluorescent lamps 2; 9 represents high-voltage side cable connectors; 10 represents rubber bushings; 12 represents a low-voltage side connector; 14 represents an inverter circuit board for driving the cold cathode fluorescent lamps 2; and 15 represents low-voltage side cable connectors.

In this embodiment, the reflector 3 having white or silver coated inner surface also serves as a lower frame.

Figure 17:
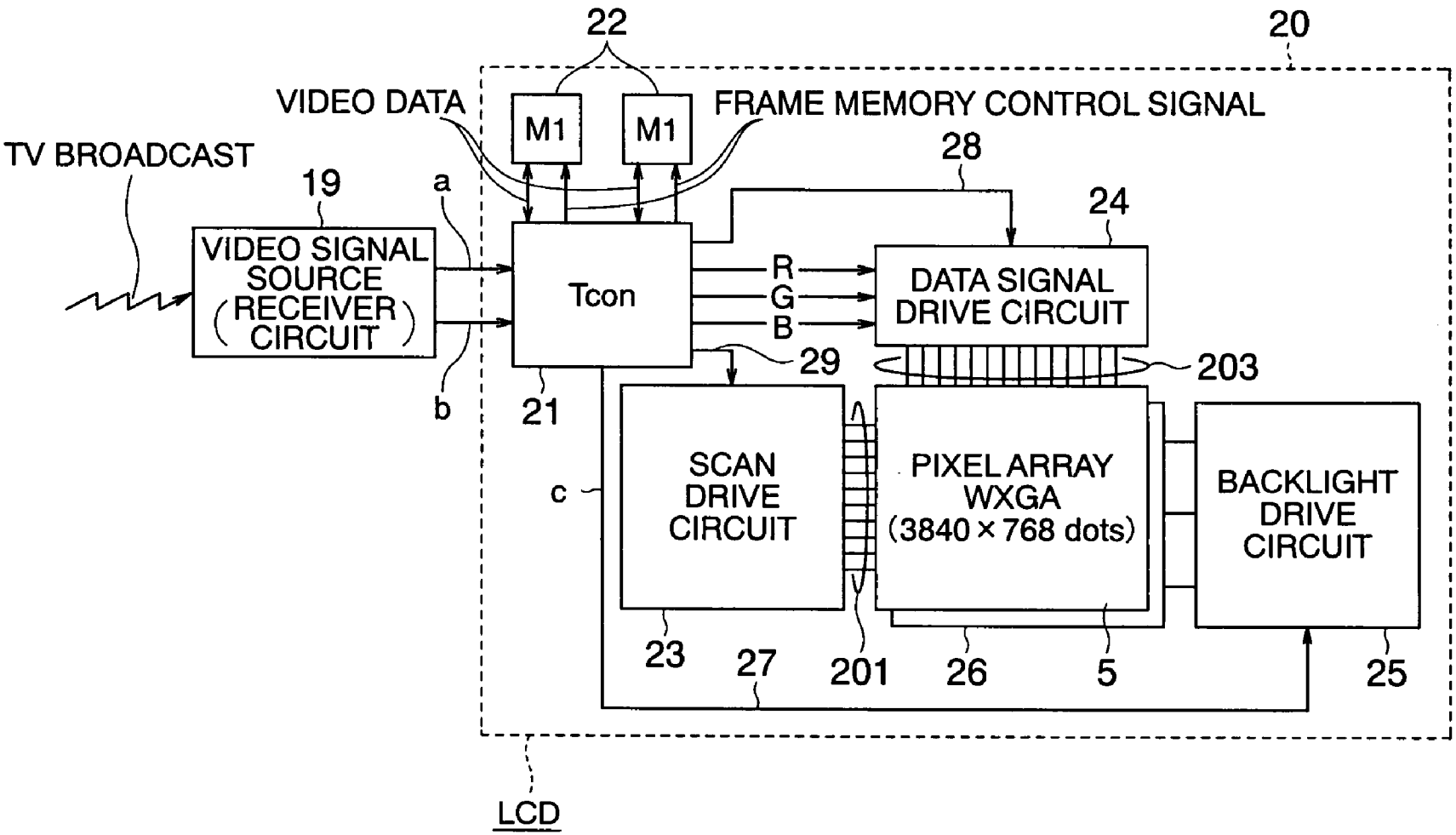
FIG. 17 illustrates an example construction of a liquid crystal display (liquid crystal display module) that uses the driving method of this invention.
Figure 18:
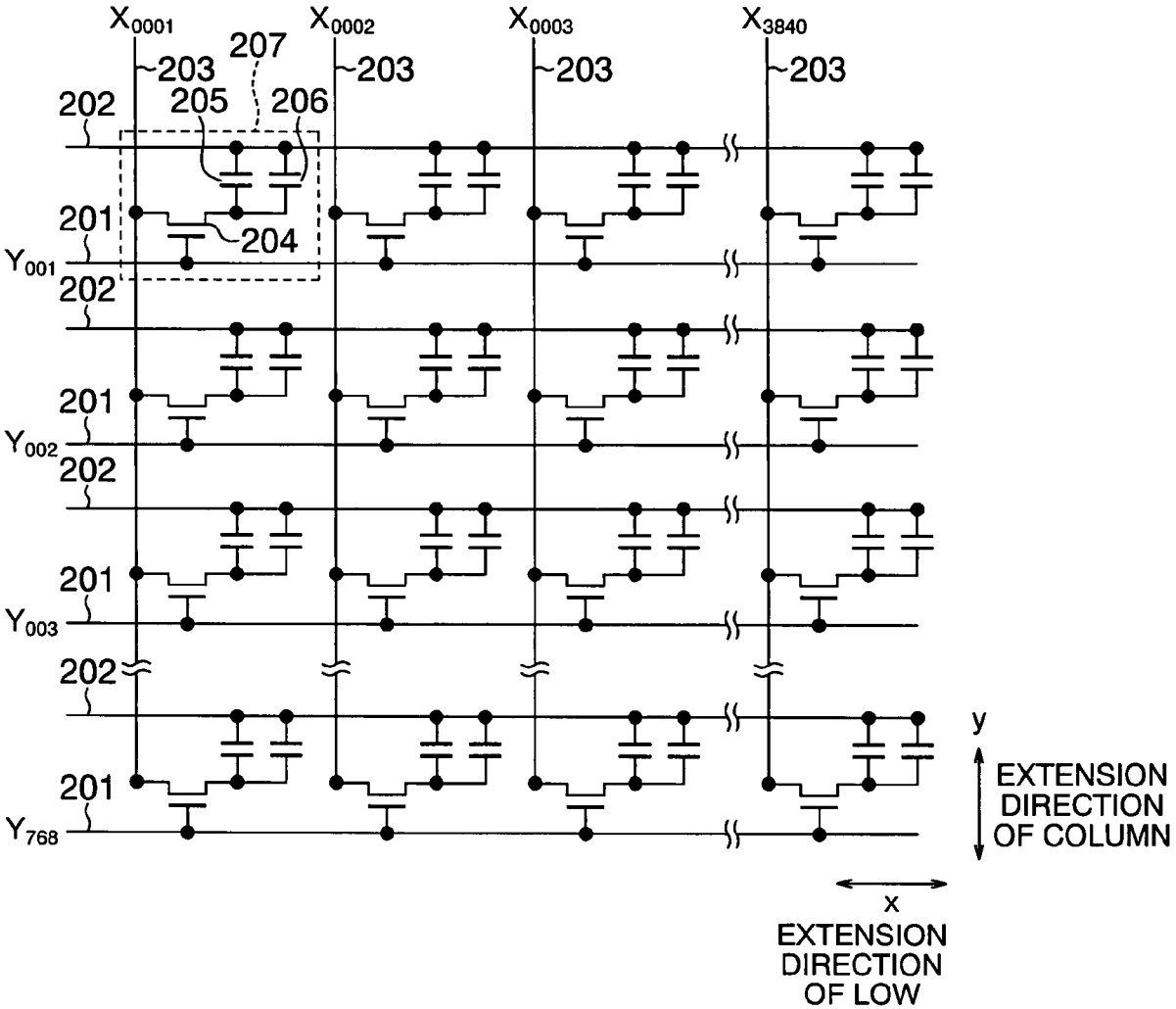
FIG. 18 illustrates an example circuitry for a part of pixel array in the liquid crystal display of FIG. 17.

FIG. 17 illustrates an example configuration of the liquid crystal display (liquid crystal display module) used in this embodiment of the invention; and FIG. 18 shows an example circuit configuration of a pixel array (display panel) provided in the liquid crystal display. In the following explanation the liquid crystal display is abbreviated LCD. Elements with the same reference numbers as those of FIG. 16 have the same or essentially identical functions.

In FIG. 17 a part enclosed by a dashed line box represents an LCD 20 which applies the present invention. The LCD 20 of FIG. 17 is mounted on a television receiver (not shown) which also has a receiving circuit (video signal source) 19 as an external circuit to receive a television broadcast. The receiving circuit 19 transforms a video signal of the received television broadcast into video data a compatible with a resolution of the LCD 20 and a timing signal b used to reproduce the video data in the LCD 20 and supplies them to the LCD 20. This timing signal b includes a vertical synchronizing signal and a horizontal synchronizing signal for controlling a transmission state of the video data a, both of which are display control signals, and a display timing signal and a dot clock signal, both of which are external clock signals.

The video data supplied to the LCD 20 is stored in a frame memory 22 for each frame period through a display control circuit 21 (e.g., timing controller) provided in the LCD 20. When the frame frequency of the video signal of the television broadcast is 60 Hz, one frame period is approximately 16.7 msec. The display control circuit 21 has a function to generate its own clock used to supply the video data a received to individual pixels of the pixel array (liquid crystal display panel) 5 of the LCD 20 at a higher frequency than those of the vertical and horizontal synchronizing signals supplied from the receiving circuit 19. The video data supplied to the frame memory 22 is transferred to the pixel array 5 according to the clock signal generated by the display control circuit 21.

The display control circuit 21 outputs a scan clock, a dot clock, a frame start signal and others to a data signal drive circuit 24 through a data signal line control bus 28. The display control circuit 21 also outputs the frame start signal and the scan clock to a scan drive circuit 23 through a scan line control bus 29.

As shown in FIG. 18, the pixel array 5 of the LCD 20 has a plurality of pixels arranged two-dimensionally in a vertical direction (arrow x) and in a horizontal direction (arrow y). In a pixel array with a resolution of WXGA (Wide eXtended Graphics Array) class, there are 768 pixel rows arrayed in the vertical direction and 1,280 pixel columns arrayed in the horizontal direction. Each pixel row is made up of a plurality of pixels arrayed in the horizontal direction. Each pixel column is made up of a plurality of pixels arrayed in the vertical direction. If the pixel array displays a color video using three primary colors, red (R), green (G) and blue (B), the 1,280 pixel columns are provided for each of the R, G, B primary colors, so a total number of the pixel columns arrayed in the horizontal direction is 3,840 columns. Hence, the pixel array 5 forms a display area (effective display area) having 2,949,120 pixels, a product of 768 pixel rows $Y_{001}$-$Y_{768}$ and 3,840 pixel columns $X_{0001}$-$X_{3840}$.

Scan lines 201 corresponding to the 768 pixel rows $Y_{001}$-$Y_{768}$ shown in FIG. 18 are drawn out from one vertical side (left side) of the pixel array 5 of FIG. 17 and connected to the scan drive circuit (vertical scan circuit) 23. Data signal lines 203 corresponding to the 3,840 pixel columns $X_{0001}$-$X_{3840}$ shown in FIG. 18 are drawn out from an upper horizontal side of the pixel array 5 of FIG. 17 and connected to the data signal drive circuit (horizontal scan circuit) 24. The scan drive circuit 23 sends a scan signal sequentially to 768 scan lines 201, from the scan line 201 corresponding to the pixel row $Y_{0001}$ to the scan line 201 corresponding to the pixel row $Y_{768}$ to select one (or two or more) from the 768 pixel rows at a time. Upon selection of the pixel row, the data signal drive circuit 24 outputs grayscale voltages corresponding to video signal levels to the 3,840 data signal lines 203 corresponding to the pixel columns $X_{0001}$-$X_{3840}$. This causes the video signals to be written into the associated pixels 207 belonging to the selected pixel row, displaying an image.

The operation of the pixels 207 in the LCD 20 generating a luminance corresponding to the input video signal can be explained as a control of voltage to a capacitance 206 formed of a liquid crystal layer and a pair of electrodes on both sides of the liquid crystal layer (see FIG. 18). The pixels 207 each have a switching element, such as a thin-film transistor 204, that is opened and closed by a scan signal applied from the scan line 201. Through this switching element 204 the video signal (voltage signal) supplied from the data signal line 203 is applied to one of the paired electrodes of the capacitance 206. Since the other electrode of this capacitance 206 is applied a predetermined voltage at all times from a common signal line 202, the light transmissivity of the liquid crystal layer making up the capacitance 206 varies according to the video signal. This light transmissivity of the liquid crystal layer is theoretically held until the pixel 207 of interest receives the next video signal. In practice, however, the light transmissivity changes because the voltage applied to one of the electrodes of the capacitance 206 progressively decreases. To prevent such a fall of the voltage applied to one of the electrodes of the capacitance 206, the pixel 207 is provided with a storage capacitor 205.

Also provided in the LCD 20 of FIG. 17 is an illuminating device 26, called a backlight unit (FIG. 16), that radiates light to the pixel array 5. The backlight unit will be referred to simply as a backlight. The LCD 20 applying this invention uses the backlight 26 (direct-type) which has a plurality of light sources, such as cold-cathode fluorescent lamps 2 of FIG. 16, external electrode fluorescent lamps and light emitting diodes, arranged two-dimensionally to face a main surface of the liquid crystal display panel 5. The construction of the direct-type LCD is as shown in FIG. 16. The plurality of light sources arranged on the backlight 26 are individually controlled for on-off operation by a backlight drive circuit 25. In the LCD 20 of this invention, the backlight drive circuit 25 is supplied a timing signal c (e.g., scan clock) from the display control circuit 21 through a backlight control bus 27.

Figure 19:
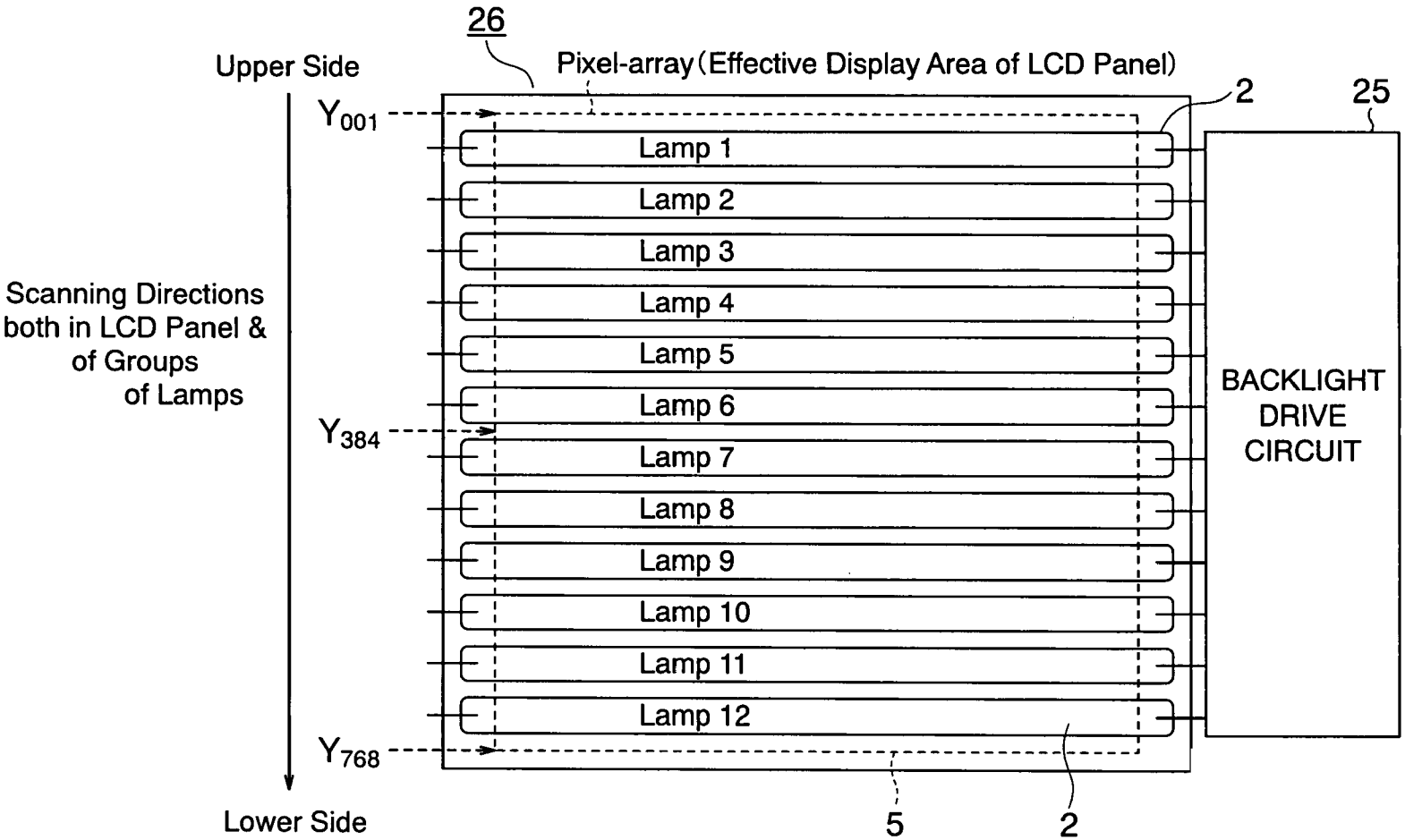
FIG. 19 is a plan view showing an outline configuration of the direct-type backlight when incorporated into the liquid crystal display.

FIG. 19 is a plan view showing a construction of the direct-type backlight 26 incorporated into the LCD 20. The outline of the pixel array of the liquid crystal display panel 5 is indicated by a dashed line. Twelve fluorescent lamps 2 are arrayed in the vertical scan direction from pixel row $Y_{001}$ to pixel row $Y_{768}$ of the liquid crystal display panel 5. The 12 fluorescent lamps 2 are contemplated to be light sources extending like tubes, such as cold cathode fluorescent lamps 2 of FIG. 16 and external electrode fluorescent lamps. Each of these light sources may be replaced with at least one row of light emitting diodes arranged in the horizontal scan direction on the liquid crystal display panel 5 (including an array of two or more rows of light emitting diodes). Each of the fluorescent lamps 2 is provided at its ends with terminals, one of which (on the right side in FIG. 19) is applied a high voltage from the backlight drive circuit 25 to turn on the lamp. The other terminal of each fluorescent lamp 2 (on the left side in FIG. 19) is applied a reference voltage (e.g., ground potential). If the fluorescent lamps 2 are replaced with rows of light emitting diodes or an array of light emitting diodes, the backlight drive circuit 25 supplies electricity to individual light emitting diodes. The application of high voltage to the fluorescent lamps 2 or electric current to individual light emitting diodes from the backlight drive circuit 25 is performed according to the timing signal that the display control circuit 21 sends to the backlight drive circuit 25 through the backlight control bus 27.

When the direct-type backlight 26 is combined with the liquid crystal display panel 5 having the WXGA class pixel array (with 768 pixel rows), a single fluorescent lamp 2 covers 64 pixel rows arranged in the pixel array. For example, a pixel row $Y_{384}$ situated at the center of the pixel array in the vertical scan direction is covered by a fluorescent lamp 6. It is noted, however, that since the fluorescent lamp 6 corresponds to pixel rows $Y_{320}$-$Y_{384}$ and a fluorescent lamp 7 corresponds to pixel rows $Y_{385}$-$Y_{448}$, the brightness of 3,840 pixels making up the pixel row $Y_{384}$ depends on the on-off states of the lamp 6 and lamp 7. This relation also holds when the fluorescent lamps 2 are replaced with the rows of light emitting diodes or the array of light emitting diodes. In the following description concerning the method of driving the LCD according to this invention, an LCD is taken up as an example which uses a direct-type backlight with a plurality of cold cathode fluorescent lamps arranged as shown in FIG. 19.

<Method of Driving Liquid Crystal Display in One Embodiment of the Invention>

The liquid crystal driving method according to one embodiment of this invention will be explained in the following. A plurality of cold cathode fluorescent lamps 2 of the direct-type backlight 26 are divided into n groups (n is a natural number and n≧3) and a blink sequence to intermittently turn on the cold cathode fluorescent lamps 2 is performed in each group.

More detailed explanation on the method of driving the liquid crystal display of this embodiment will follow.

Figure 20:
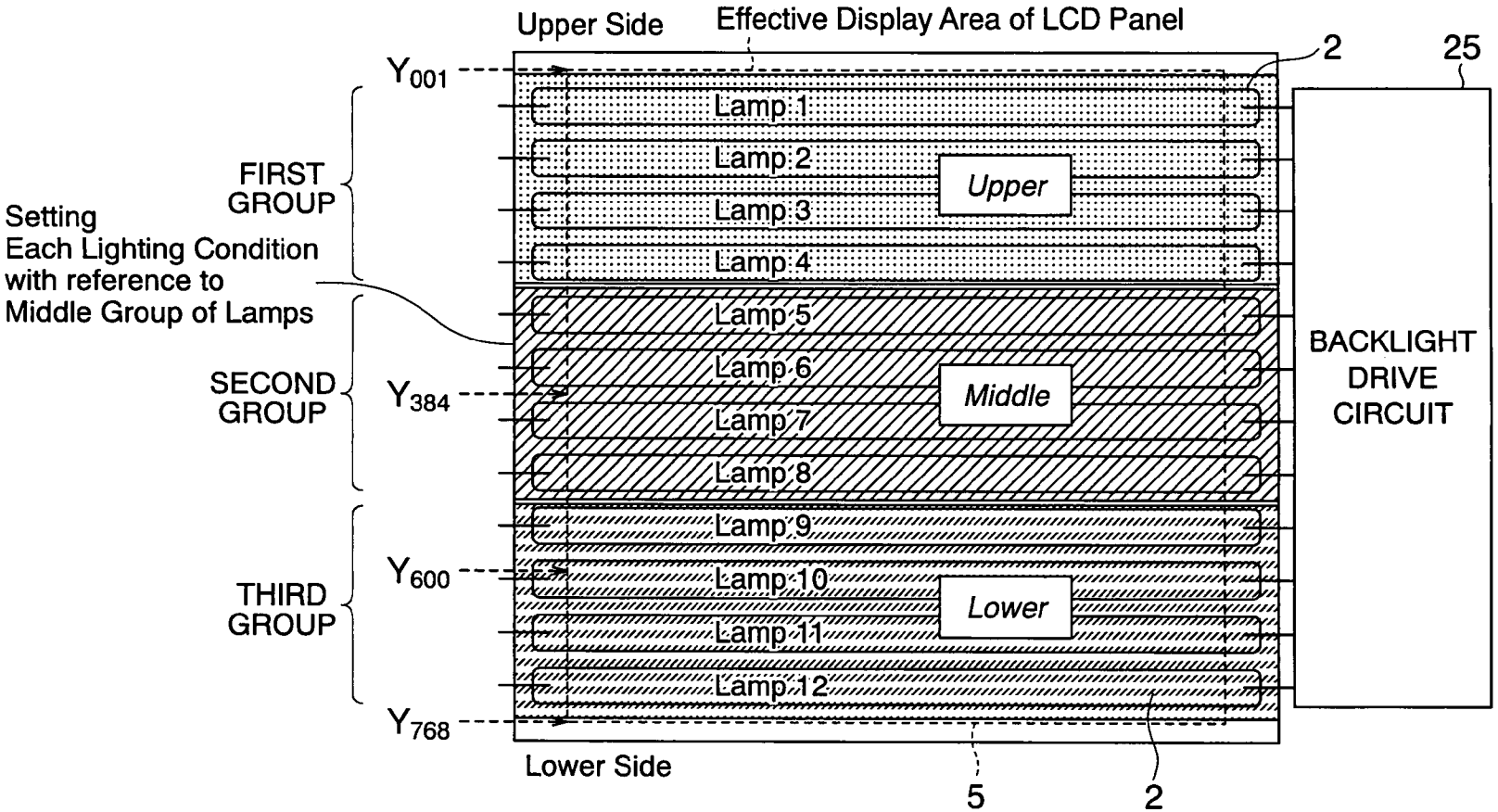
FIG. 20 illustrates a configuration of the direct-type backlight unit in which a plurality of cold cathode fluorescent lamps are divided into three groups.

Let us take up an example case in which the direct-type backlight unit 26 of the liquid crystal display module of FIG. 16 has 12 cold cathode fluorescent lamps 2 arranged as shown in FIG. 19. In this embodiment, the 12 cold cathode fluorescent lamps 2 (Lamp 1-Lamp 12) are divided into three groups (n=3) of four lamps in the vertical scan direction (which is also referred to as a display line selection direction) of the pixel rows on the liquid crystal display panel 5. Thus, the 12 fluorescent lamps (in this case, cold cathode fluorescent lamps) shown in FIG. 19 are divided into a first group of Lamp 1 to Lamp 4 (corresponding to pixel rows $Y_{001}$-$Y_{256}$), a second group of Lamp 5 to Lamp 8 (corresponding to pixel rows $Y_{257}$-$Y_{512}$) and a third group of Lamp 9 to Lamp 12 (corresponding to pixel rows $Y_{513}$-$Y_{768}$), as shown in FIG. 20. Since the pixel row $Y_{001}$ is situated at an upper end of a picture (television picture) displayed on the liquid crystal display panel 5 and the pixel row $Y_{768}$ at a lower end of the picture, four fluorescent lamps Lamp 1-Lamp 4 belonging to the first group are described to be situated at the upper area of the screen, four fluorescent lamps Lamp 5-Lamp 8 belonging to the second group are described to be situated at the middle area of the screen, and four fluorescent lamps Lamp 9-Lamp 12 belonging to the third group are described to be situated at the lower area of the screen. As described above, this embodiment explains a case in which a plurality of light sources are divided into three groups (n=3) along the display line selection direction, a direction in which display lines are selected sequentially when a video signal voltage is written into individual pixels of the liquid crystal display panel 5.

An index of motion picture performance of the liquid crystal display of this embodiment will be explained by referring to FIG. 1. As shown in FIG. 1, a black bar (with a grayscale 0, for instance) is displayed on a white background (e.g., grayscale 255). When this bar is moved horizontally, edge portions of the bar look blurred. Based on a luminance profile at this time, a width between relative luminance 10% and 90% is defined to be a BEW (Blurred Edge Width).

The BEW is proportional to the moving speed of an image, so a value of BEW normalized with the moving speed is defined to be N-BEW (Normalized-BEW; BEW/(moving speed)). The smaller the value of N-BEW, the better the motion picture performance.

In the following explanation therefore, the N-BEW is used as a motion picture performance. For details of an evaluation method, see JP-A-2001-204049.

Figure 21:
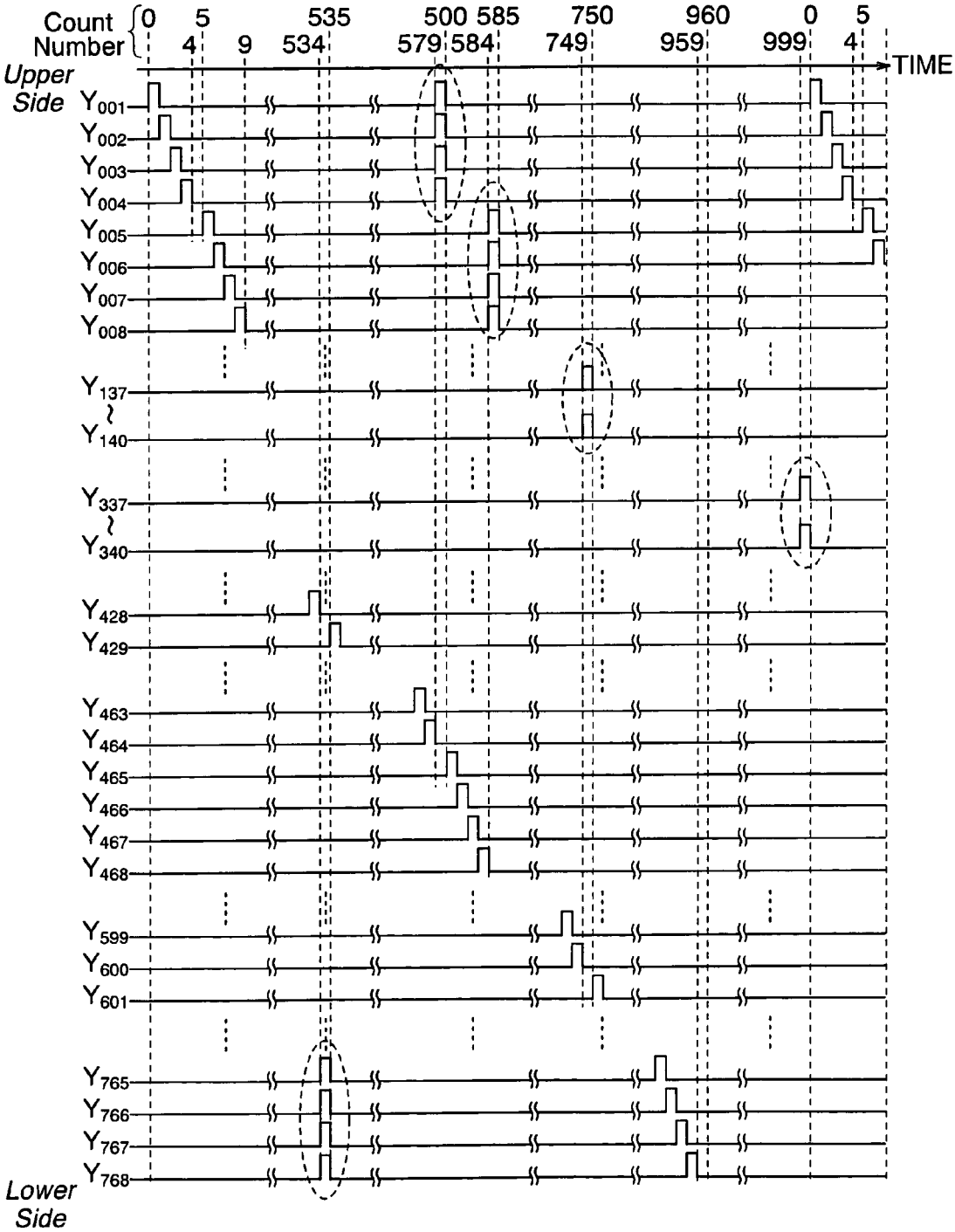
FIG. 21 is a waveform diagram of input voltage signals to main pixel lines on the liquid crystal display panel.

In the evaluation of the motion picture performance of the liquid crystal display 20 described above, a driving sequence of the liquid crystal display panel 5 will be explained by referring to the waveform diagram of FIG. 21. FIG. 21 is an input waveform diagram showing voltage signals (video signals or their equivalents) applied to main pixel rows of the liquid crystal display panel 5. This liquid crystal display, as shown in FIG. 17, is mounted on a television receiver.

A video signal of a television broadcast received by the television receiver is transformed by the receiving circuit (video signal source) 19 into video data complying with the resolution of the liquid crystal display panel, i.e., WXGA standard, and then fed to the display control circuit 21 of the liquid crystal display 20 for each frame period. The receiving circuit 19 also supplies to the display control circuit 21 of the liquid crystal display 20 a vertical synchronizing signal, a horizontal synchronizing signal, a display timing signal and a dot clock signal, all these signals matching the video data. The display control circuit 21 refers to these input signals to store the video data into the frame memory 22. If the video signal of a television broadcast is input to the receiving circuit at a frame frequency of 60 Hz, the frequency of the vertical synchronizing signal is also 60 Hz. In this embodiment, one frame period of 16.7 msec is divided into a video data transfer period during which video data is transferred to 768 pixel rows and a vertical retrace interval equivalent to a time needed to transfer video data to 32 pixel rows. Hence, the frequency of the horizontal synchronizing signal is set to 48 kHz to enable video data transfer to 800 pixel rows. The dot clock signal (data signal line control bus 28) to send video data (video signal) to 3,840 pixels in each pixel row is set to about 184 MHz but can be further increased by appropriately setting the horizontal retrace interval. The display timing signal is, in a sense, an identification signal used to prevent those signals (false video data), which are entered into the display control circuit 21 from the video data transmission line during the vertical or horizontal retrace interval, from being stored into the frame memory.

The video signal, which we will explain with reference to FIG. 21, is generated by having the display control circuit 21 read the video data temporarily stored in the frame memory 22 and transfer the video data to the data signal drive circuit 24 and also having the data signal drive circuit 24 reference the video data to generate the video signal. In FIG. 21 are shown signal waveforms for individual pixel rows which include rectangular waveforms enclosed by oval dashed lines and rectangular waveforms that are not. The rectangular waveforms not enclosed by the oval lines represent timings at which the video signals are supplied to 3,840 individual pixels belonging to the pixel row of interest, while the rectangular waveforms enclosed by the oval lines represent timings at which blanking signals are supplied to the 3,840 individual pixels of the pixel row. The blanking signals are signals to erase the video signals already fed to the pixels and can also be generated as by the display control circuit 21 or the data signal drive circuit 24 irrespective of the video data stored in the frame memory. Further, as can be seen from the waveform of the pixel row $Y_{001}$ in FIG. 21, the blanking signals in this embodiment are supplied to individual pixels in such a manner that they follow the video signals supplied to individual pixels for each frame period.

In this driving sequence, if a voltage signal is generated as a blanking signal to drop the pixel's luminance to the lowest level (or near it), the luminance of each pixel in the liquid crystal display panel 5 (pixel array) reaches a predetermined luminance before falling to the minimum level in each frame period, so an pulse-like illumination found in CRT causes an image to be displayed on the screen. In a liquid crystal display, the blanking signal that drops the pixel luminance to the lowest level is also a voltage signal that minimizes the light transmissivity of that part of the liquid crystal layer which corresponds to the pixel 207 of interest shown in an equivalent circuit of FIG. 18. In the following description, such a blanking signal is also referred to as "black" or "black data."

In the driving sequence for the liquid crystal display panel 5 in this embodiment, after the video signal input to 3,840 pixels making up one pixel row is performed four times, i.e., video signals are input to four pixel rows (e.g., $Y_{465}$-$Y_{468}$), another four pixel rows (e.g., $Y_{005}$-$Y_{008}$) are selected and a blanking signal is applied to a total of 15,360 pixels in the selected four pixel rows. Following the application of the blanking signal, video signals are supplied to a pixel row (e.g., $Y_{469}$) next to the pixel row (e.g., $Y_{468}$) which was supplied video signals immediately before. In the driving sequence for the liquid crystal display panel 5, therefore, each time four pixel rows are supplied successively with video signals, another pixel rows are applied a blanking signal. In other words, in the driving sequence for the liquid crystal display panel 5 of this embodiment, the video signal input to the 768 pixel rows, which can theoretically be completed by performing the pixel row selection 768 times in each frame period, requires at least 960 pixel row selections. Further, this embodiment provides a time margin in each frame period equivalent to a time needed to select 40 pixel rows. This is intended to avoid an erroneous operation that may be caused by the writing of video data into the frame memory 22 and the reading of the video data from the frame memory 22 during a certain frame period (e.g., Nth frame period, where N is a natural number) and the next frame period (e.g., (N+1)th frame period). Thus, the driving sequence for the liquid crystal display panel 5 of this embodiment sets the frequency of the horizontal synchronizing signal (scan clock) so as to enable the pixel row selection to be performed 1,000 times in one frame period. The horizontal synchronizing signal, the dot clock (required to have a frequency of 230.4 MHz or higher) that matches the horizontal synchronizing signal, and the display timing signal that distinguishes the video signal input and the blanking signal input are all generated by the display control circuit 21 of the liquid crystal display. The frame memory 22 connected to the display control circuit 21 of, FIG. 17 have two memories (M1, M2), one of which stores video data of odd-numbered frame periods and the other stores video data of even-numbered frame periods.

A count number shown in FIG. 21 represents the number of pulses of the horizontal synchronizing signal (scan clock), which is generated 1,000 times in each frame period. The count number corresponding to the start of the video signal input to pixel row $Y_{001}$ is set to "0" which means that this is a start of a frame period. The video signal input to the pixel array during this frame period is ended with 959th count that corresponds to the video signal input to pixel row $Y_{768}$. During a period from 959th count to 1,000th count (a period following the preceding frame period up to 0th count of the next frame period), no video signal is input to the pixel array. The blanking signal to four pixel rows $Y_{001}$-$Y_{004}$ including the first pixel row $Y_{001}$ in response to 579th count of the horizontal synchronizing signal is carried out immediately after the input of video signal to the pixel row $Y_{464}$ and immediately before the input of video signal to the pixel row $Y_{465}$. The blanking signal input to the next four pixel rows $Y_{005}$-$Y_{008}$ in response to 584th count of the horizontal synchronizing signal is performed immediately after the video signal input to pixel row $Y_{468}$ and immediately before the video signal input to pixel row $Y_{469}$. Then, the blanking signal input to 427 pixel rows, which are situated below the four pixel rows $Y_{337}$-$Y_{340}$ ($Y_{341}$ and after) that are applied the blanking signal in response to 999th count, is performed during the next frame period. Thus, the blanking signal input to pixel row $Y_{768}$ during the current frame period is ended with 535th count during the next frame period. The blanking signal input to the pixel row $Y_{768}$ in a previous frame period immediately preceding the current frame period beginning with 0th count shown at the left end of FIG. 21 is ended with 535th count in the current frame period (i.e., immediately after the video signal input to pixel row $Y_{428}$ in the current frame period and immediately before the video signal input to pixel row $Y_{429}$ in the current frame period).

In such a driving sequence for the liquid crystal display panel, the duration in one frame period in which the pixels belonging to the pixel rows $Y_{001}$-$Y_{004}$ hold the video signals is equal to a duration from 576th to 579th pulse of the horizontal synchronizing signal. During the period from 421st to 424th pulse these pixels hold the blanking signal. For pixels belonging to other pixel rows than $Y_{001}$-$Y_{004}$, a ratio between the duration in one frame period in which they hold the video signals and the duration in one frame period in which they hold the blanking signals is the same as that of the pixels of the pixel rows $Y_{001}$-$Y_{004}$. Therefore, if the blanking signal is a voltage signal that minimizes the light transmissivity of the liquid crystal layer corresponding to the pixels, each of these pixels is displayed black for about 42% of one frame period regardless of the video signal. In the following description, an operation of displaying pixels making up the pixel array in black for a predetermined duration in one frame period is referred to as a "black insertion" and a percentage of that black insertion duration with respect to one frame period is referred to as a "black insertion percentage." The "black insertion" technology is described in JP-A-2003-280599 and its corresponding U.S. Patent Application Publication No. 2004/0001054.

Figure 22:
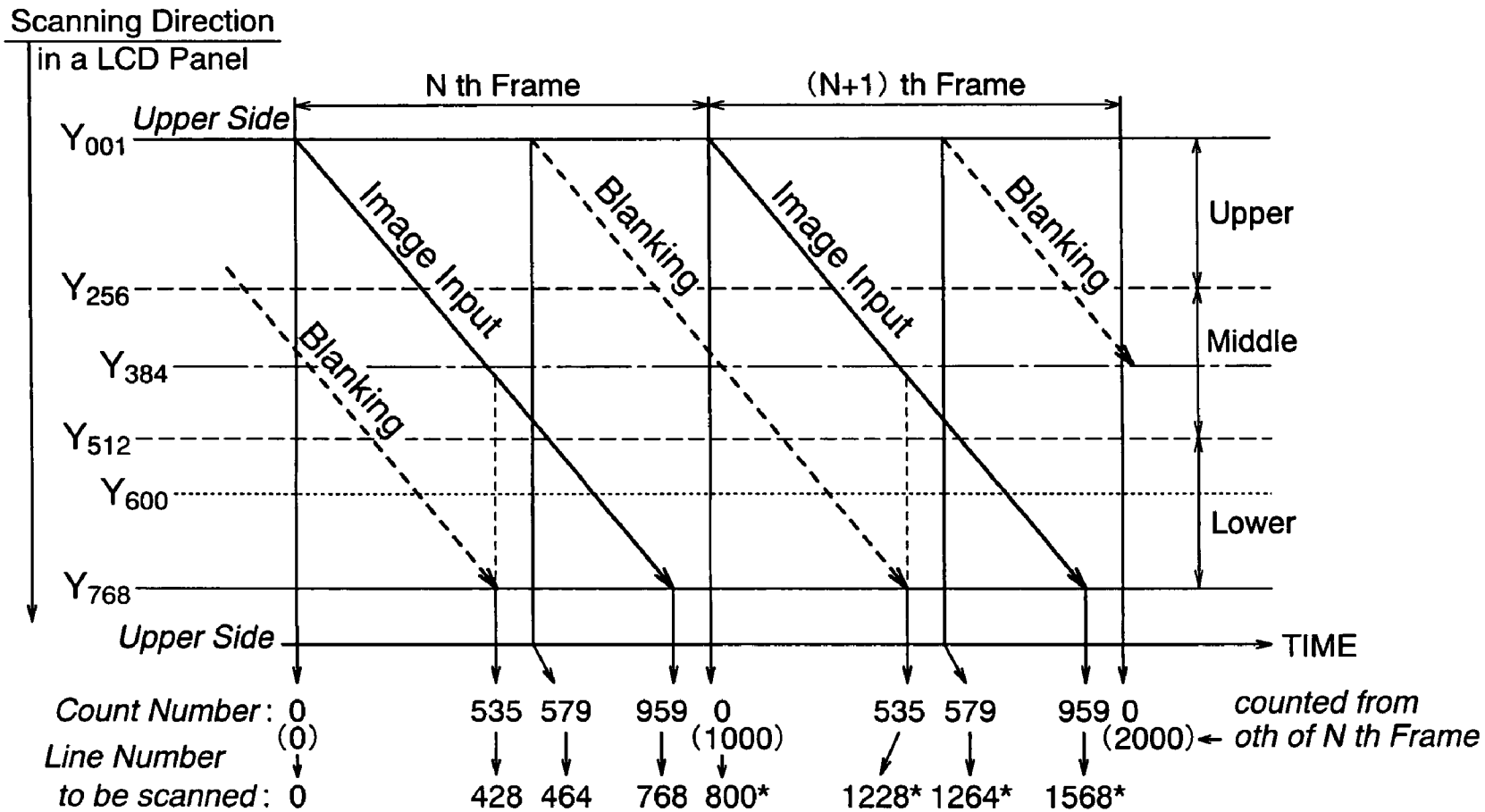
FIG. 22 is a signal diagram macroscopically representing the waveforms of FIG. 21.

The video signal input and blanking signal input in each frame period shown in FIG. 21 can be depicted macroscopically as shown in FIG. 22. The number of pixel rows supplied with video signals and the number of pixel rows supplied with blanking signals before a 5th pulse of the horizontal synchronizing signal, that initiates the pixel row selection for the fifth time, is applied are both four pixel rows. Thus, a gradient of the selected pixel rows in the vertical scan direction with respect to the time axis (abscissa), when macroscopically viewed, is the same for both the video signal input and the blanking signal input. If the waveforms of FIG. 21 are assumed to be ones in an Nth frame period (N is a natural number), it is seen that the blanking signals in the Nth frame period are terminated in the next (N+1)th frame period.

Figure 2A:
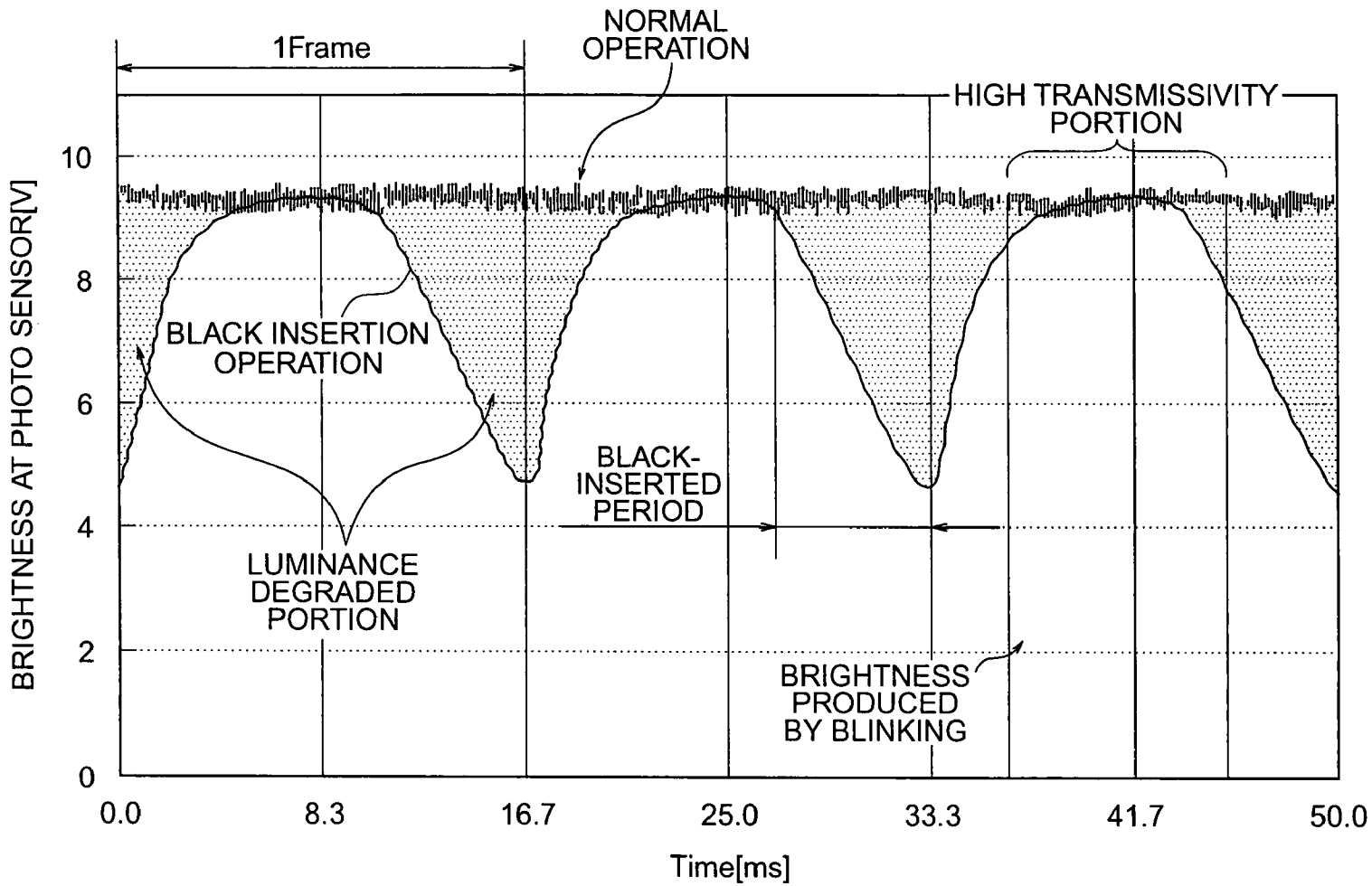
FIGS. 2A and 2B are graphs showing a relation between a brightness response waveform and a motion picture performance during a black insertion operation.

FIG. 2A shows a brightness response waveform that changes depending on whether black data (simply referred to as black) is inserted or not. This waveform represents a measurement of the brightness of a screen using a photo sensor when the entire screen of the liquid crystal display panel is displayed in white.

As shown in FIG. 2A, the black insertion produces a pulse-like brightness waveform, improving the motion picture performance. But the brightness lowers during the black insertion period.

Figure 2B:
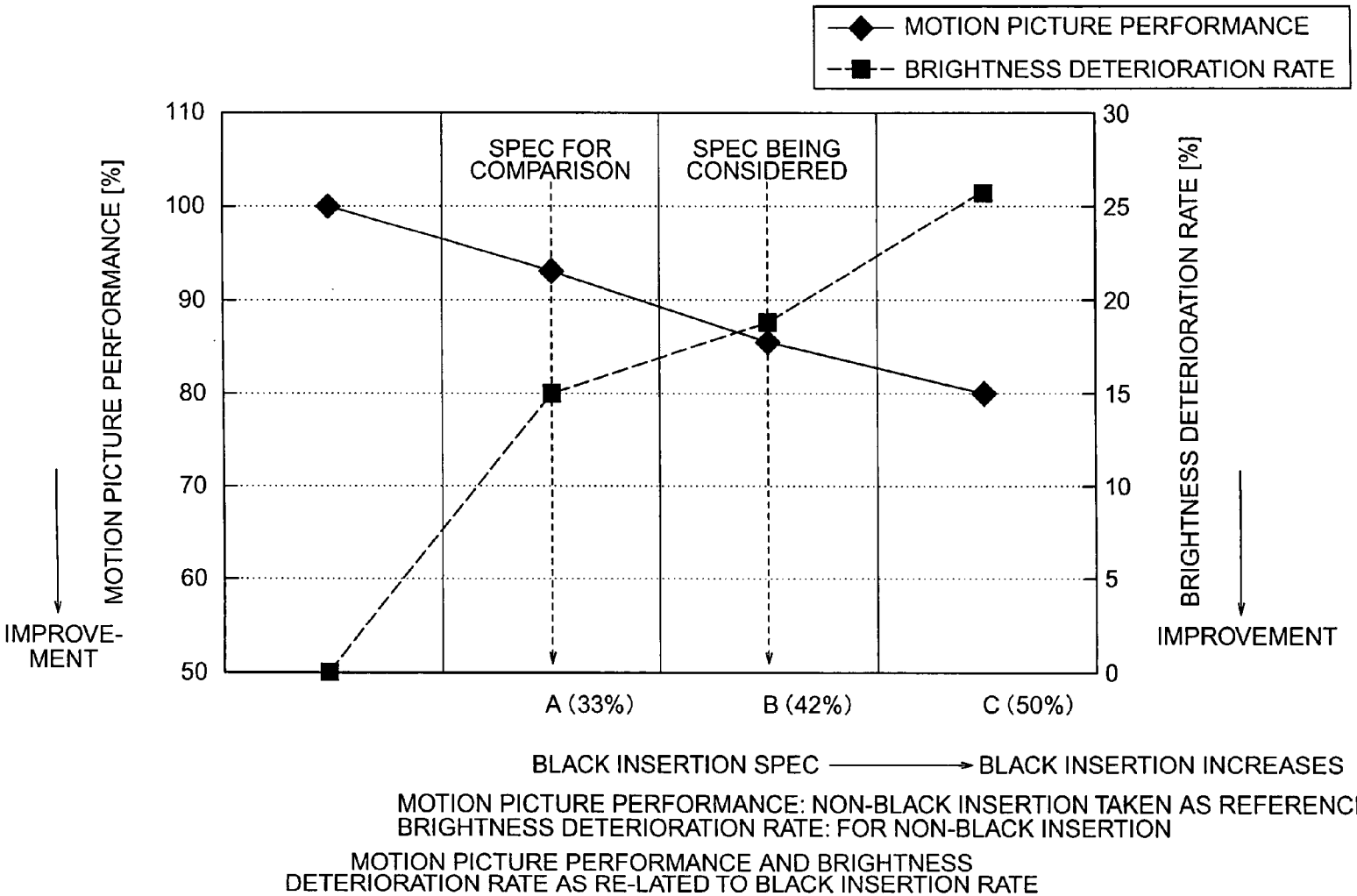

FIG. 2B shows a motion picture performance and a brightness deterioration rate as related to the black insertion percentage. This data is obtained by driving the liquid crystal display panel with a black insertion percentage of 0% (data indicated as "none"), 33% (specification A), 42% (specification B) and 50% (specification C) and then by evaluating the motion picture performances under the respective driving conditions by using the blurred edge width (BEW), a width of a range in which an edge of a black bar moving horizontally on a white screen looks blurred, as explained with reference to FIG. 1. The motion picture performance (%) uses as a reference or 100% a value of BEW that is measured by driving the liquid crystal display panel with the black insertion percentage of 0% and turning on the backlight continuously. Values of BEW under other driving conditions are indicated as relative values to the 100% or reference of BEW. The evaluation of the brightness deterioration rate is as described above with reference to FIG. 2A. A value of the brightness deterioration rate is calculated as follows. A brightness measured with the black insertion percentage of 0% is defined to be a "reference brightness (brightness deterioration rate=0%)." Subtracting the measured brightness at the associated black insertion percentage from the reference brightness to find a difference and then taking a percentage of this difference with respect to the reference brightness results in a value of the brightness deterioration rate.

As shown in FIG. 2B, increasing the black insertion percentage improves the motion picture performance but it also increases the brightness deterioration rate. So, the black insertion percentage cannot be increased readily in the continuous illumination operation of the ordinary hold type display system.

To deal with this problem, the inventors came to an idea that, if a black insertion is used, the brightness of the display screen may be maintained without being affected by the black insertion period by turning on the backlight at a timing when the brightness waveform reaches a high transmissivity and that the motion picture performance may be further enhanced by increasing the black insertion percentage. As can be seen from FIG. 22, in one frame period that is initiated with the video signal input to pixel row $Y_{001}$, there is a duration in an intermediate part of the frame period in which the black insertion is stopped (a duration from 535th count to 579th count). Under these circumstances, the turn-on timing of each group of light sources is so set that the turn-on periods of the n groups of light sources differ from one another and match the timings of video signal input to those pixel rows which correspond to the light source groups and that the turn-on period of each light source overlaps the duration in which the black insertion is not executed.

In the following an operation at the black insertion percentage of 42% (specification B) will be explained. In addition to data of the black insertion percentage of 42% (specification B), FIG. 2B also shows data of the black insertion percentage of 33% (specification A) for comparison.

As described above, FIG. 21 and FIG. 22 show a driving sequence of the liquid crystal display panel at the black insertion percentage of 42%. Thus, the timings of the video signal input and the blanking signal input shown in these figures represent those of the black insertion percentage B that keep the brightness and the motion picture performance of the display screen at desired levels. In FIG. 21 and FIG. 22, the points in time at which the video signal and the blanking signal are input to the respective pixel rows have been explained using the pulse number of the horizontal synchronizing signal. In the driving sequence of the liquid crystal display panel of this embodiment, however, since a time margin equivalent to a time duration needed to select 40 pixel rows is provided in each frame period, it is difficult to identify from the pulse number of the horizontal synchronizing signal an address $Y_{xxx}$ of the pixel row to which the video signal is to be input ($Y_{xxx}$: xxx is a three-digit natural number; e.g., $Y_{768}$). Therefore in the following explanation, instead of the pulse number of the horizontal synchronizing signal, an address of a pixel row to which the video signal is input is used to represent a point in time in a "time band" spanning two frame periods—a current frame period (Nth frame period in FIG. 22) initiated by the video signal input to pixel row $Y_{001}$ and the next frame period ((N+1)th frame period in FIG. 22). An example of this time denotation is a line number to be scanned that matches a typical pulse number of the horizontal synchronizing signal in FIG. 22. For example, a point in time at which the video signal input to the pixel array in the Nth frame period is completed is denoted 768, which is a scan line number, instead of 959, which is a pulse number of the horizontal synchronizing signal.

What should be noted here in this time denotation is that virtual scan line numbers 769-800 representing the above-mentioned time margin are added to the real 768 scan line numbers (addresses of pixel rows) to which the video signals are actually input. For instance, after the video signal input to the pixel array during the Nth frame period is completed, a point in time during the next (N+1)th frame period at which the video signal input to the pixel array starts is denoted 800, which is a scan line number. In FIG. 22, the scan line numbers attached with an asterisk are either the virtual scan line numbers described above or the line numbers in a (N+1)th frame period including the virtual scan line numbers. In an intermittent lighting operation or blinking operation of a light source described later, a turn-on start time of the light source is represented by a scan line number that identifies a vertical scan position of the pixel array (i.e., an address of a pixel row to which video signals are input) at the turn-on start time. A desired turn-on start time will be explained as follows.

In this embodiment, the start time of the light source blinking operation is set by taking as a reference a turn-on start time of a group of light sources facing a middle area of the pixel array (display area of the liquid crystal display panel 5) in the vertical scan direction (y). In a backlight facing the WXGA-class pixel array having 768 pixel rows arrayed in a vertical direction, the light source group opposing the central part of the pixel array is those light sources which correspond to pixel rows in the pixel array, $Y_{384}$ or $Y_{385}$. In the direct-type backlight of FIG. 20, these light sources correspond to a second group (middle group) of fluorescent lamps, Lamp 5-Lamp 8. The address of the pixel row situated in the central part of the pixel array changes according to a resolution of the array. For example, in an SXGA (Super eXtended Graphics Array)-class pixel array having vertically arranged 1,024 pixel rows, the address of central pixel row is $Y_{512}$ and $Y_{513}$; and in a UXGA (Ultra eXtended Graphics Array) of vertically arranged 1,200 pixel rows, the address is $Y_{600}$ and $Y_{601}$. Depending on the way a plurality of light sources in the direct-type backlight are grouped, a boundary between a y-th group (y is a natural number and $1<y<n$) of light sources and a (y+1)th group of light sources may come at the center of the pixel array. In that case, the turn-on start time of either the y-th group of light sources or the (y+1)th group of light sources as the light source facing the center of the pixel array is used as a reference for the "start time of light source blinking operation" described above.

In light of the essence of this invention, unless the scan drive circuit 23 and the data signal drive circuit 24 in FIG. 17 are exchanged in their positions, there is no need to consider a light source facing the center of the pixel array along the "horizontal" scan direction. Thus, in the description that follows, the "center along the vertical scan direction of the pixel array" is simply referred to as a "middle area of pixel array" or "screen middle area." Further, the turn-on start time of the light source (light source group) facing the middle area of the pixel array (screen middle area) is denoted a "blink start timing." This blink start timing may, in a backlight turn-on sequence described later, differ from the start time of the blinking operation of the light sources in the backlight as a whole but invariably provides a reference for the setting of the blinking operation. This embodiment will be described as follows by taking a liquid crystal display with a backlight of FIG. 20 for example.

Figure 3:
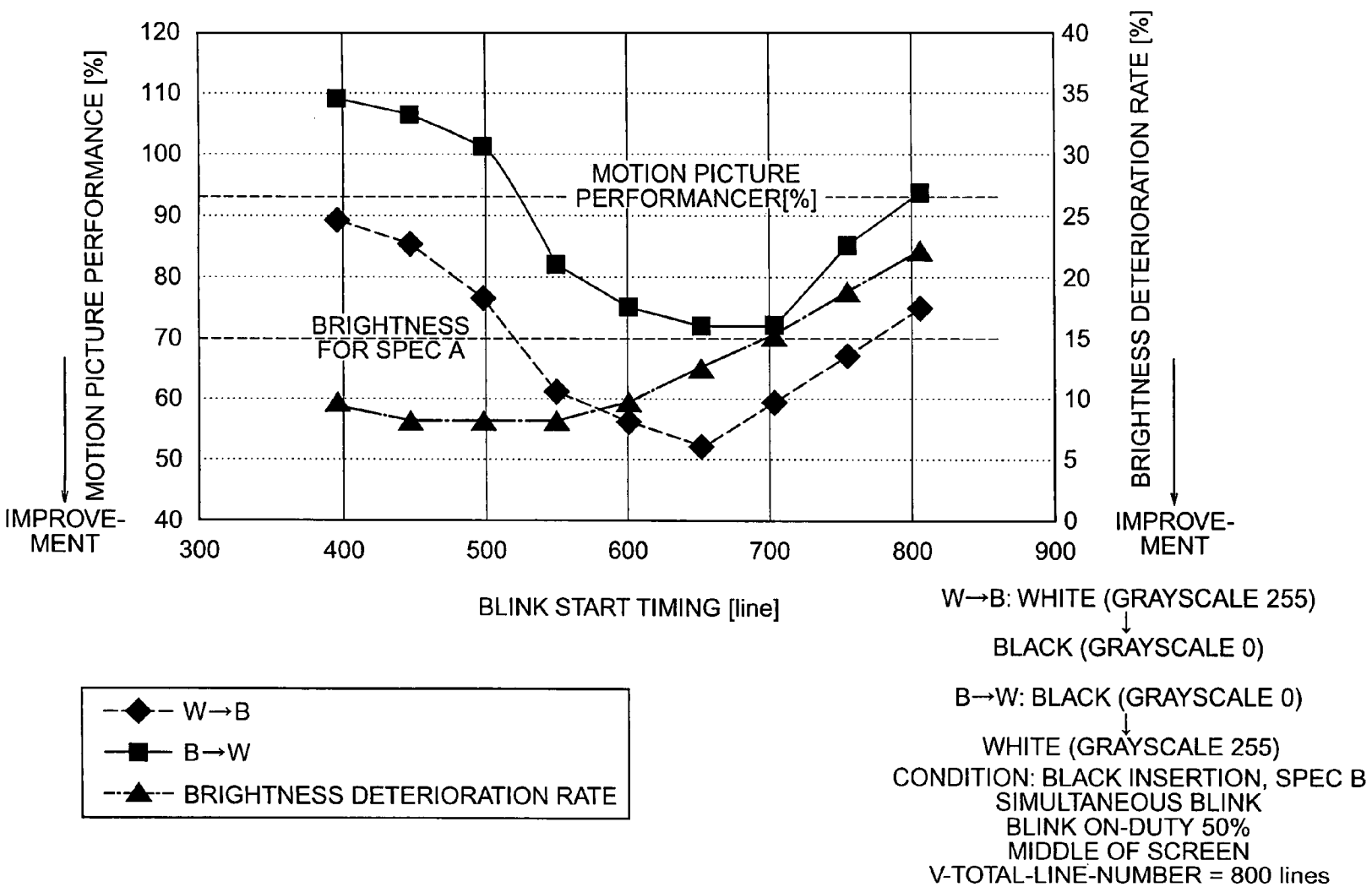
FIG. 3 is a graph showing a motion picture performance and a brightness deterioration rate as related to a blink start timing.

FIG. 3 shows measurements of the motion picture performance and the brightness deterioration rate at the middle area of the liquid crystal display that employs a display driving method using a combination of the black insertion and the blinking operation of backlight (light source). This experiment adopts a "simultaneous blinking operation" of the backlight in which the turn-on start times of a light source group facing an upper area of the screen (first group) and of a light source group facing a lower area of the screen (third group) are made to match the turn-on start time of a light source facing the middle area of the screen (second group). The motion picture performance was measured by the method that was explained with reference to FIG. 1 and the brightness deterioration rate was measured by the method which was explained with reference to FIG. 2A. Both of these measurements were evaluated by focusing on the central part of the pixel array.

The motion picture performance (%), as explained by referring to FIG. 1, uses as a reference the "blurred edge width" of a black bar moving horizontally on a white screen of the liquid crystal display which has a continuously illuminating backlight on the liquid crystal display panel driven at the black insertion percentage of 0%. The blurred width is measured on both sides of the bar in the bar moving direction. When the black bar moves on the screen from left to right, the left edge of the bar looks blurred as pixels (a column of pixels) near the left edge changes from black to white. The width of this blur is denoted "B→W" in FIG. 3. The right edge of the bar also looks blurred as pixels (another column of pixels) near the right edge changes from white to black. The width of this blur is denoted "W→B" in FIG. 3. In this experiment, each time the blink start timing is changed, measurements are made of the blurred edge widths "B→W" and "W→B." These measured values are expressed as percentages of their associated reference values (the reference or 100% represents a blurred edge width value measured on a liquid crystal display that is driven at the black insertion percentage of 0% and whose backlight is illuminated continuously) and plotted in the graph of FIG. 3.

As for the brightness deterioration rate (%), a brightness measured on a liquid crystal display that is driven at the black insertion percentage of 0% and whose backlight is illuminated continuously is defined to be a reference brightness (brightness deterioration rate=0%). A brightness measured at each black insertion percentage is subtracted from the reference brightness to produce a difference, and a percentage of this difference with respect to the associated reference brightness is plotted in a graph of FIG. 3.

The line number on the abscissa representing the blink start timing corresponds to the "scan line number" in FIG. 22. Thus, the data on line 800 represents the measurement when, after the video signal input to the pixel array during a certain frame period is finished (at scan line number of 768), the blink start timing is matched to the start time of the next frame period. It is noted that "W→B" shown in FIG. 3 and in the drawings referenced in the following represents BEW shown at (A) of FIG. 1 while "B→W" represents BEW shown at (B) of FIG. 1. A "Blink ON Duty" indicated in the drawings represents a ratio of the period in which each light source group is turned on to the associated frame period (about 16.7 msec). For example, if the blink start timing is set at line 600, each light source group is kept turned on until the video signal input to 200 pixel rows in the next frame period following the current frame period is finished.

As shown in FIG. 3, the motion picture performance and the brightness deterioration rate vary depending on the blink start timing. As the data values (%) of "W→B" and "B→W" decrease, the "blurred edge width" becomes narrower, improving the motion picture performance. Also, as the data value (%) of the brightness deterioration rate decreases, the display quality of moving picture improves. As shown in FIG. 3, it is found that, depending on the blink start timing (scan line number), the motion picture performance does not improve as expected even by performing the blinking operation on the backlight. FIG. 3 also shows in a dashed line a motion picture performance of a liquid crystal display which has a liquid crystal display panel driven at the black insertion percentage of 33% (specification A) and a continuously illuminated backlight. In a liquid crystal display which has a liquid crystal display panel driven at the black insertion percentage of 42% (specification B) and a simultaneous blink-operated backlight, setting the blink start timing to line 500 or earlier results in the blurred edge width "B→W" becoming wider than that of the liquid crystal display operated with specification A or that of the liquid crystal display which has a liquid crystal display panel driven at the black insertion percentage of 0% and a continuously illuminated backlight. This setting therefore degrades the motion picture performance.

In light of the result of FIG. 3, this embodiment adopts as the blink start timing a line 600 which produces little brightness deterioration and assures an almost best motion picture performance. Setting the blink start timing in this manner causes the light source group facing the middle area of the screen (second group) to start illuminating after the video signal input to the corresponding pixel rows in the pixel array, $Y_{257}$-$Y_{512}$, is finished. If the liquid crystal display panel operation at the black insertion percentage of 42% and the backlight simultaneous blink operation are combined, the light source group facing the pixel rows $Y_{001}$-$Y_{140}$ (first group) begins to be turned on when the blanking signal is applied to these pixel rows and the light source group facing the pixel rows $Y_{601}$-$Y_{768}$ (third group) begins to be turned on before the video signals are supplied to these pixel rows.

In this state, the motion picture performance and the brightness of the upper and lower parts of the screen were checked. The check result is shown in FIG. 4A.

Figure 4A:
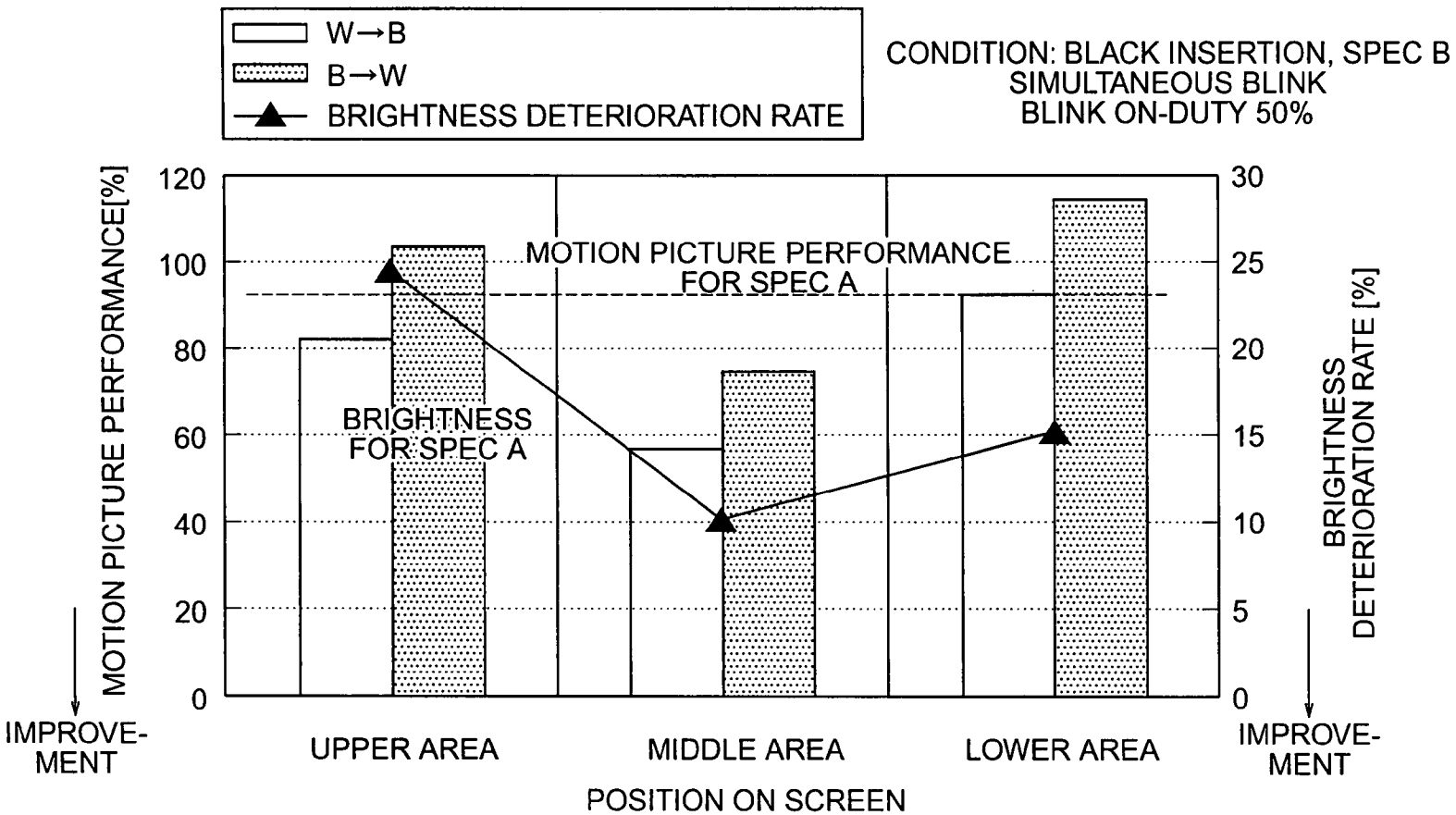
FIGS. 4A and 4B are graphs showing a motion picture performance, a brightness deterioration rate and a chromaticity variation during a combined operation of a black insertion and a simultaneous blinking.
Figure 4B:
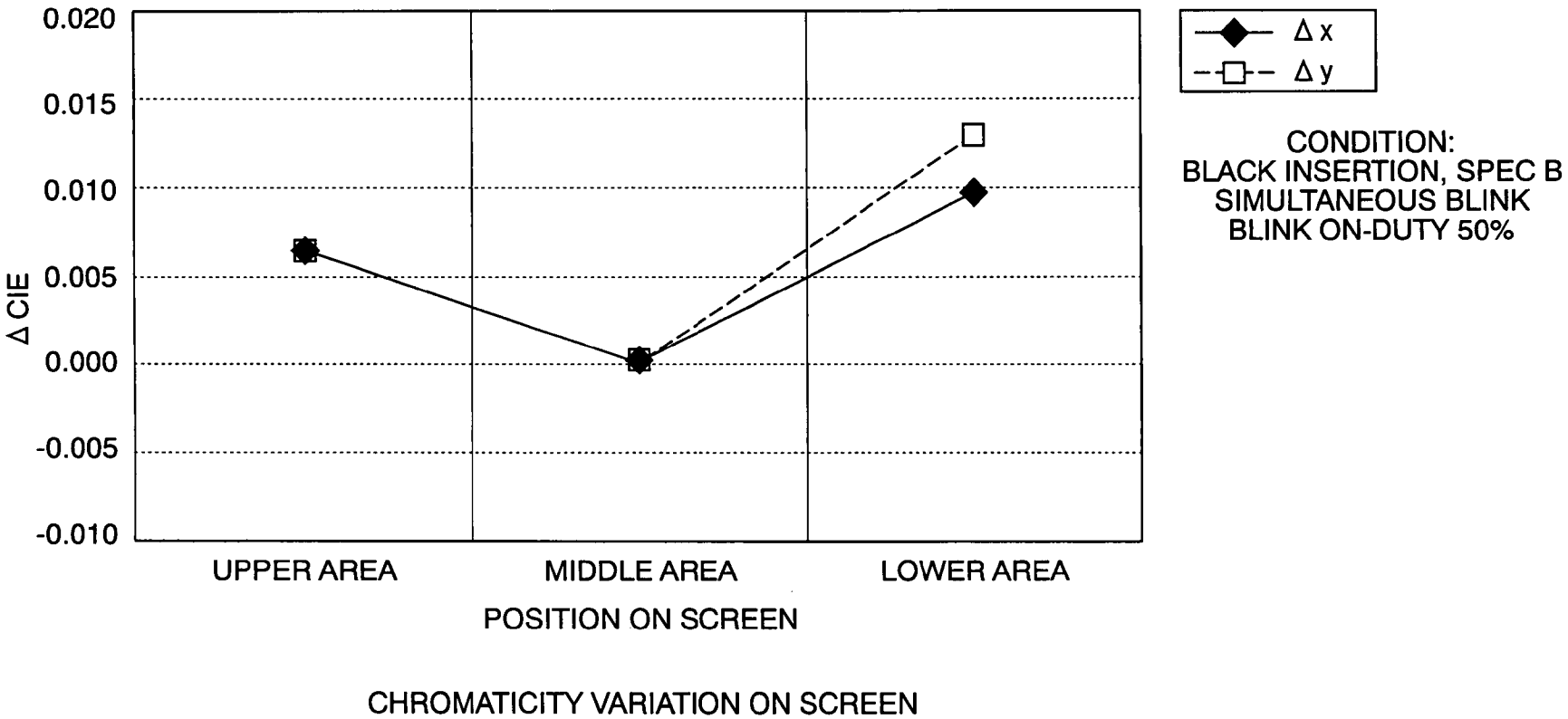

It is seen from FIG. 4A that the brightness deterioration is large at the upper part of the screen and that there is no improvement in the motion picture performance in the upper and lower parts of the screen. As shown in FIG. 4B, the chromaticity also greatly changes.

These results are due to a data write timing difference between different parts of the screen, namely, a timing mismatch between the data writing and the blinking.

Figure 5A:
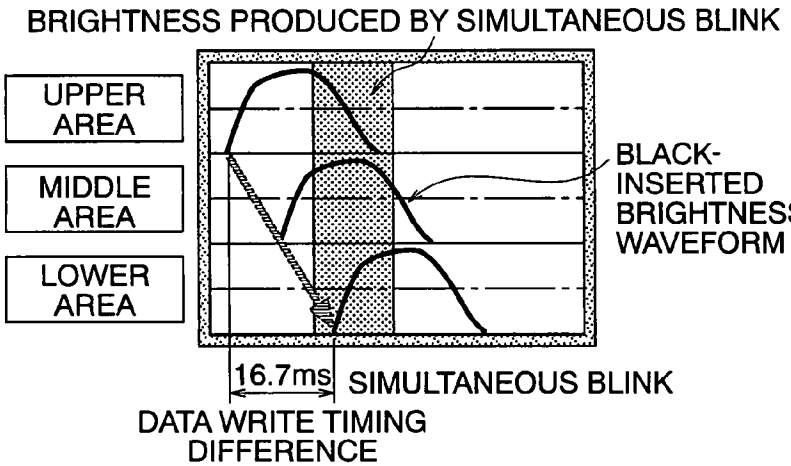
FIGS. 5A, 5B and 5C are graphs showing relations between a data writing time difference and a blink timing.
Figure 5B:
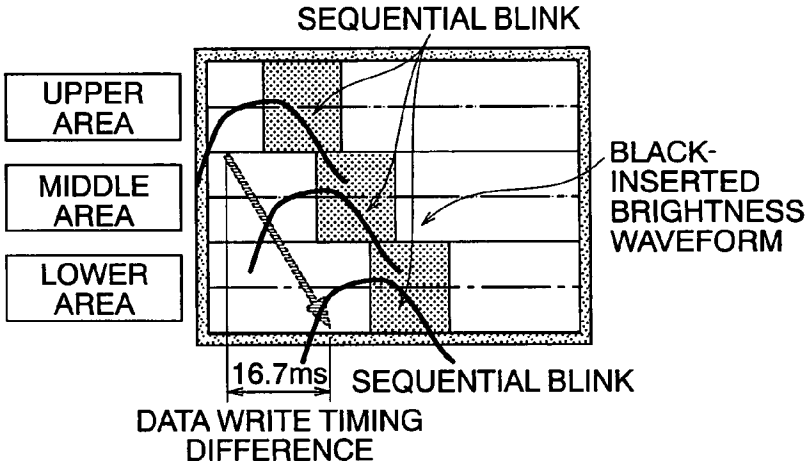
Figure 5C:
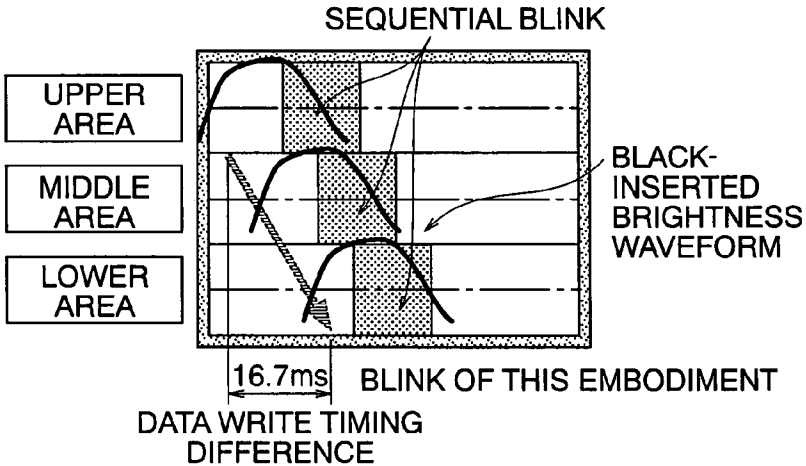

FIGS. 5A, 5B and 5C show relations between a data write timing difference and a blink timing in a black insertion operation. In these figures hatched portions represent periods in which light sources are turned on and others are periods during which they are turned off.

FIG. 5A shows a simultaneous blinking operation in which all light sources are turned on simultaneously. In this case, at the upper part of the screen the cold cathode fluorescent lamps 2 turn on in the latter half of the brightness waveform (representing a transmissivity characteristic of the liquid crystal when a video signal voltage is applied), while at the lower part of the screen the lamps 2 turn on in the first half of the brightness waveform. Therefore, no improved characteristic is obtained.

To cope with this problem, a sequential blinking operation is required which, as shown in FIG. 5B, changes the turn-on start time and the turn-on end time among the light source groups corresponding to the pixel rows being written, according to the data write timing difference between the different pixel rows in the pixel array. FIG. 5C shows a relation between the data write timing difference and the blink timing during a black-inserted blink operation of this embodiment described later that sequentially turns on light sources of a backlight.

Figure 6:
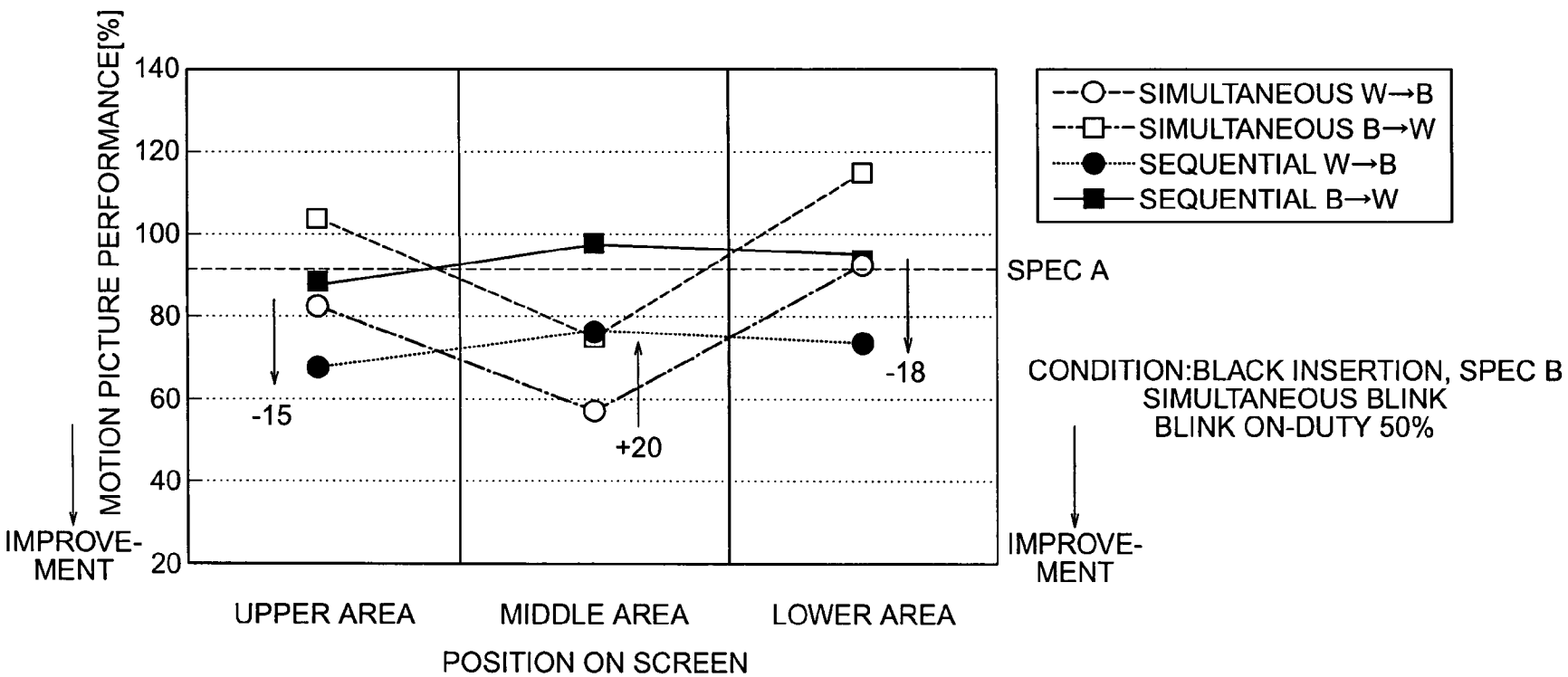
FIG. 6 is a graph showing an example motion picture performance during a combined operation of a black insertion and a sequential blinking.

FIG. 6 shows a result of evaluation of the motion picture performance when the cold cathode fluorescent lamps 2 arranged to face the upper, middle and lower parts of the screen (pixel array) are sequentially turned on with time difference among them according to the timings (video data inputting time to pixel rows $Y_{001}$, $Y_{257}$, $Y_{513}$) at which data is written to the pixel rows arranged in the upper, middle and lower parts of the screen.

As can be seen from the measurements in FIG. 6, the sequential blink operation of the backlight (data represented by black circles and black squares) improves the motion picture performances at the upper and lower parts of the screen over those of the simultaneous blink operation (data represented by white circles and white squares) (by 15 percent at the upper part of the screen and 18 percent at the lower part), whereas the motion picture performance at the middle part of the screen deteriorates (−20%).

Figure 7:
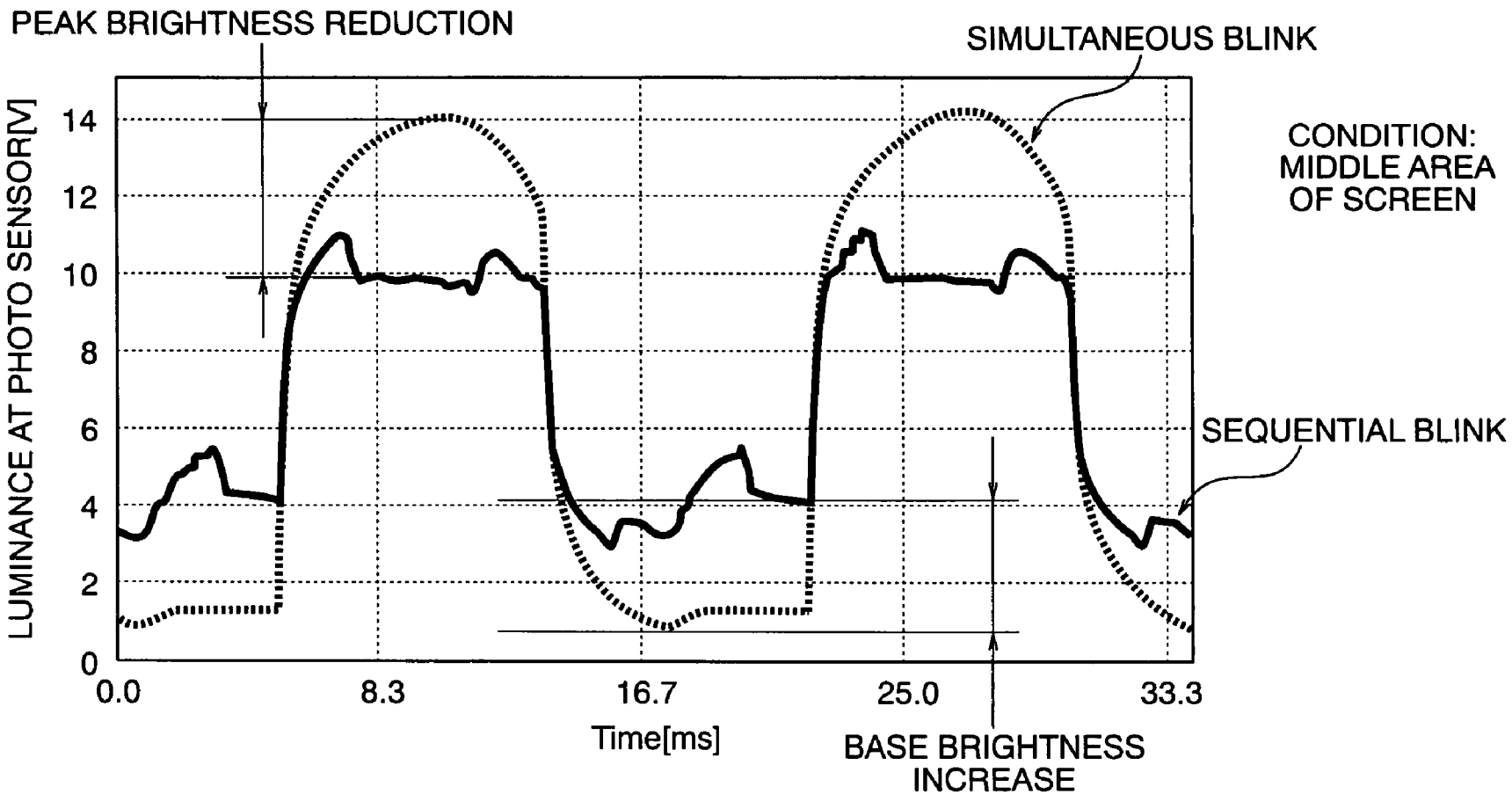
FIG. 7 illustrates a brightness response waveform for a case of FIG. 6.

The brightness response waveform at the middle part of the screen is shown in FIG. 7 along with the waveform produced by the simultaneous blink operation.

When compared to the simultaneous blink operation, the sequential blink operation has the peak brightness fall in the latter half of each frame period (at near 10 msec and 27 msec). Further, since the base brightness between the peaks is higher than that of the simultaneous blink operation, the pulse waveform produced by the sequential blink operation is greatly different from that of the simultaneous blink operation.

This is considered due to a leakage of light of the lamps 2 in the direct-type backlight from the upper and lower areas of the screen.

Figure 8:
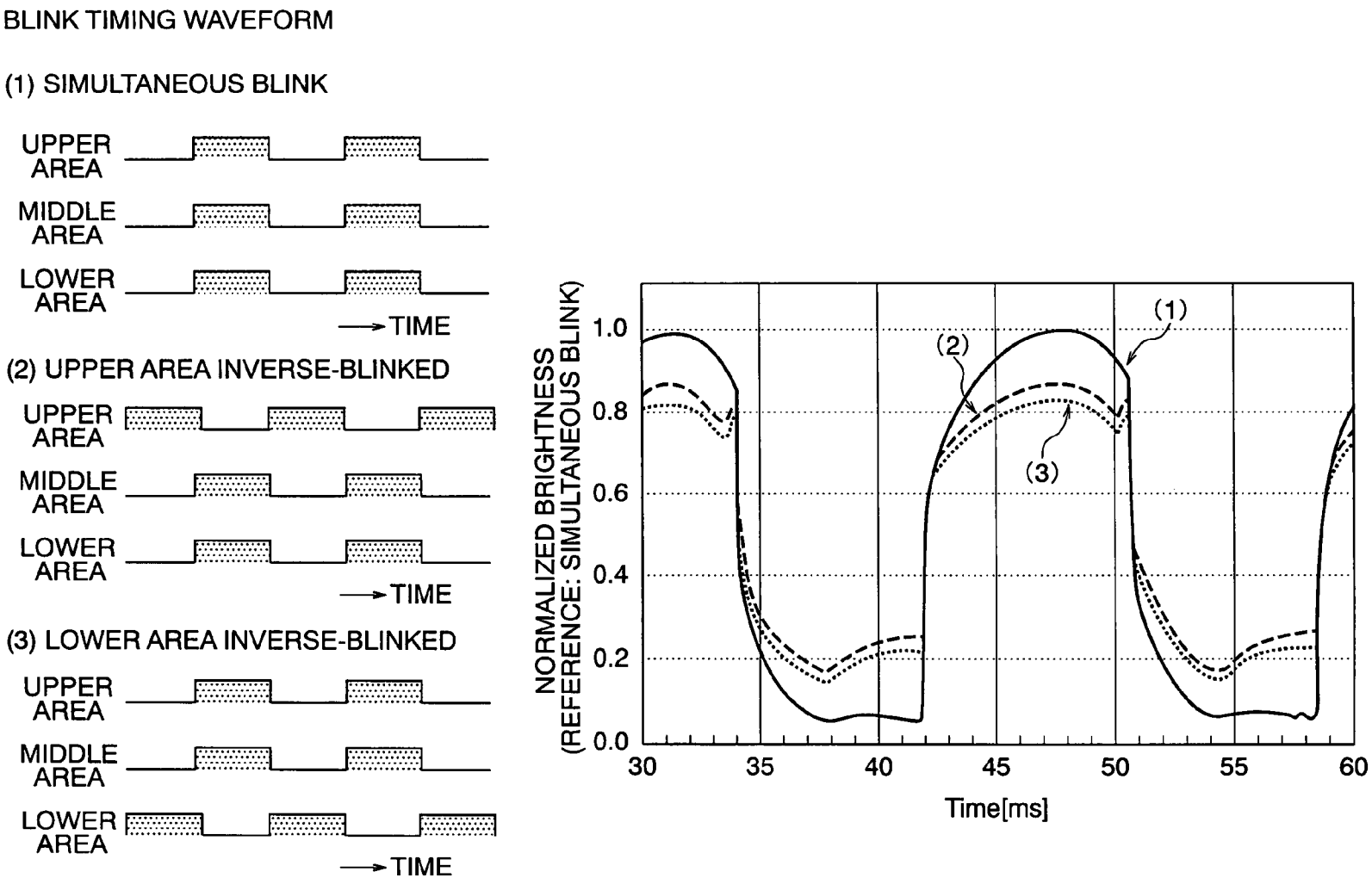
FIG. 8 is a diagram showing how a leakage of light from the upper and lower areas of a screen affects the display performance.

FIG. 8 shows a result of test in which light leakage from the upper and lower areas of the screen of the liquid crystal display panel is checked.

In this test, the screen of the liquid crystal display panel is divided into upper, middle and lower areas and the cold cathode fluorescent lamps 2 of FIG. 16 are also divided into three groups facing the respective areas of the screen. The backlight is constructed so that each group of lamps can be turned on independently of others. The three groups of cold cathode fluorescent lamps 2 are referred to as upper, middle and lower group that respectively match the upper, middle and lower area of the screen. Their turn-on waveforms are shown in FIG. 8 on the left side. Rectangular hatched portions of the waveforms represent periods in which the cold cathode fluorescent lamps 2 (light sources) are turned on. In other periods the lamps are kept turned off. Response waveforms when the upper, middle and lower groups of cold cathode fluorescent lamps are turned on simultaneously and response waveforms when the upper or lower group of lamps are turned on at an inverted timing of the middle group were evaluated. The evaluation has found that the turn-on operation of the upper or lower group of cold cathode fluorescent lamps at an inverted timing produces response waveforms with a lower peak brightness and an higher base brightness than those of the simultaneous turn-on operation. This is almost similar to that of the sequential blink operation shown in FIG. 7.

It is therefore verified that the light leakage from the upper and lower areas of the screen has some effects on the middle area of the screen.

Figure 9A:
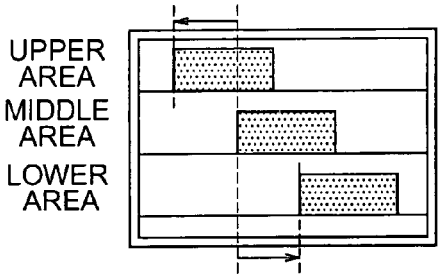
FIGS. 9A, 9B and 9C are graphs showing motion picture performances when upper and lower area blink timings are changed with a middle area blink timing taken as a reference.
Figure 9B:
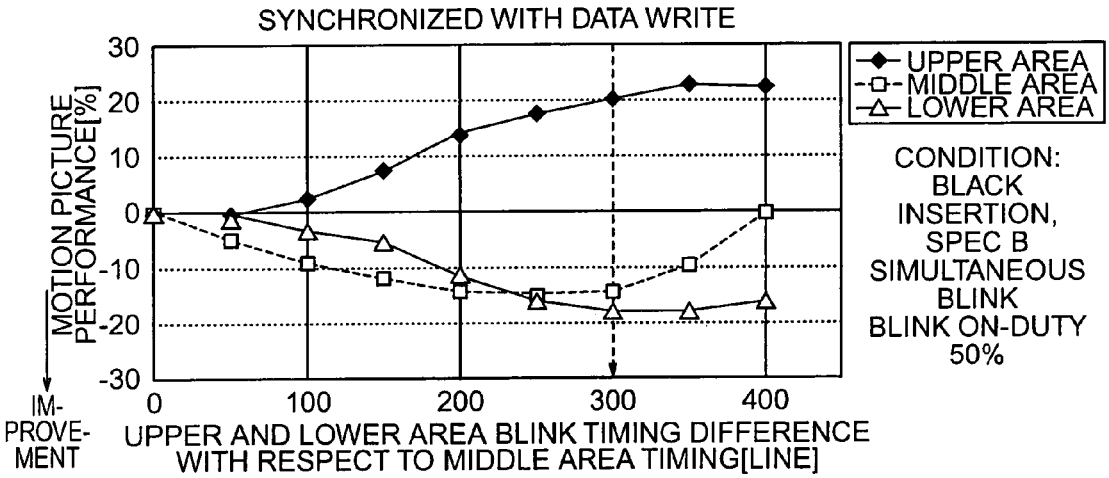
Figure 9C:
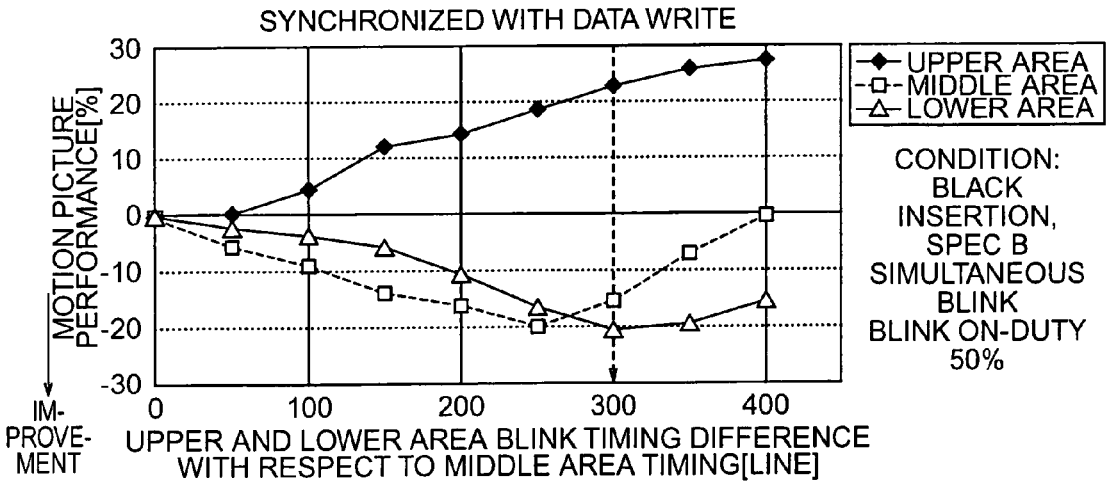

FIG. 9A shows a waveform for the sequential blink operation in which the turn-on start times (blink timings) of the cold cathode fluorescent lamps 2 facing the upper and lower area of the liquid crystal display panel are made to differ, and FIGS. 9B and 9C show motion picture performances in the sequential blink operation. In the waveform of FIG. 9A, high-level periods represent turn-on periods and low-level periods represent turn-off periods. The cold cathode fluorescent lamps 2 facing the middle area of the WXGA-class liquid crystal display panel with 768 pixel rows begin to turn on at the time when the data is written into the pixel rows provided in the middle area (time at which the video signals are input to pixel row $Y_{257}$).

As shown in FIGS. 9B and 9C, with the intermittent turn-on start timing (referred to as a blink timing) of the cold cathode fluorescent lamps 2 facing the middle area of the screen taken as a reference, the blink timings of the lamps 2 situated in the upper and lower areas of the screen are changed. In this condition, the motion picture performance is degraded in the middle area of the screen. In the upper and lower areas of the screen, as the blink timing approaches the time of initiating the data write to the pixel rows in each area, the motion picture performance improves. The screen of the WXGA-class liquid crystal display panel has 256 pixel rows (scan lines) in each of its upper, middle and lower area. The abscissa in the graphs of FIGS. 9B and 9C represents, in the form of scan line number explained with reference to FIG. 22, a time difference between the turn-on start times of the cold cathode fluorescent lamps 2 facing the upper and lower areas of the liquid crystal display panel screen and the turn-on star times of the lamps 2 facing the middle area. Thus, at the time of line 256 on the abscissa of the graphs of FIGS. 9B and 9C, the blink timings of the cold cathode fluorescent lamps 2 situated in the upper and lower areas of the screen synchronizes with the time of initiating the data write to the pixel rows in the upper and lower areas of the screen. Therefore, the motion picture performances in the upper and lower areas of the liquid crystal display panel screen are considered to be the best when the lamp blink timing matches the data write timing in the associated area.

While in the upper and lower areas of the liquid crystal display panel screen the motion picture performance improves because the blink timing coincides with the data write timing, the motion picture performance in the middle area of the screen is considered to be degraded by the light leakage from the upper and lower areas of the screen and the blink timing of the middle group of lamps.

Figure 10A:
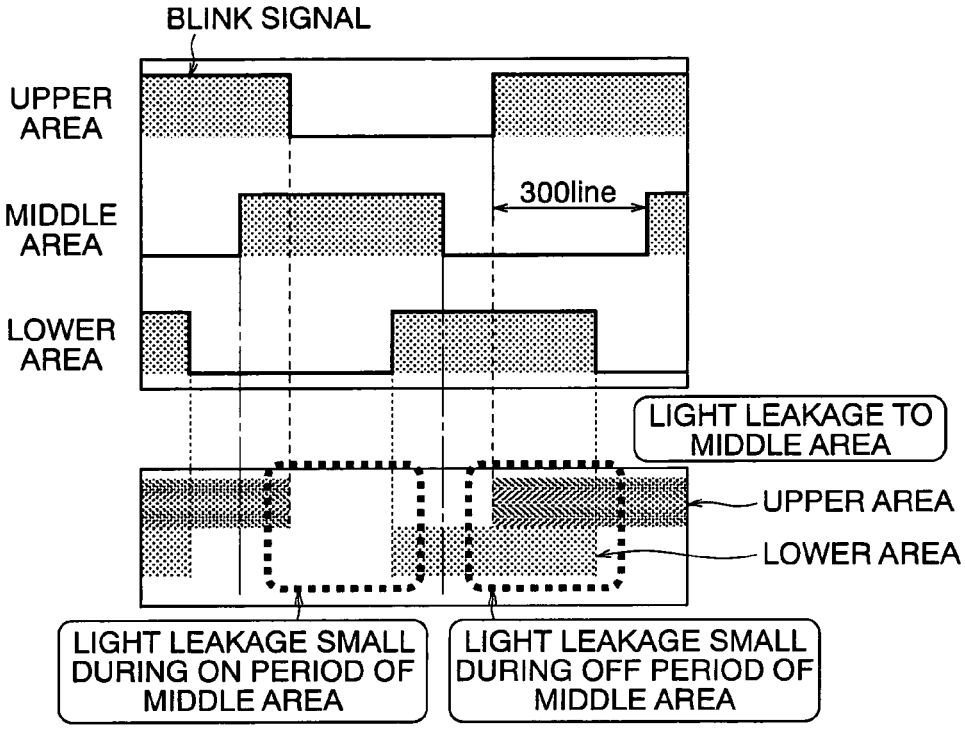
FIGS. 10A and 10B are diagrams showing a light leakage when the upper and lower area blink timings are changed with a middle area blink timing taken as a reference.

FIG. 10A shows a sequential blink operation in which the blink timings of the cold cathode fluorescent lamps 2 facing the upper and lower areas of the liquid crystal display panel screen are synchronized with the timing of initiating the data write to the pixel rows arranged in the upper and lower areas of the screen. Such a backlight drive sequence is referred to as "sequential blink synchronized with data write." If the backlight is operated by the sequential blink synchronized with data write, leaked light from the upper and lower areas of the screen concentrates in the turn-off period of the middle group of lamps, so the light leakage is eliminated during the turn-on period of the middle group.

Thus, the brightness of the middle area of the screen during the turn-on period decreases and the brightness during the turn-off period increases. This is considered to produce the brightness response waveform as shown in FIG. 7.

Therefore, the video characteristic of the middle area of the screen is good when the light leakage from the upper and lower areas of the screen is concentrated in the turn-on time of the middle area of the screen. This means that there is a trade-off between the video characteristic improvement of the middle of the screen and those of the upper and lower areas of the screen.

Hence, the blink timings of the cold cathode fluorescent lamps 2 situated in the upper and lower areas of the screen needs to be adjusted to minimize the degradation of the video characteristic of the middle area of the screen.

Figure 10B:
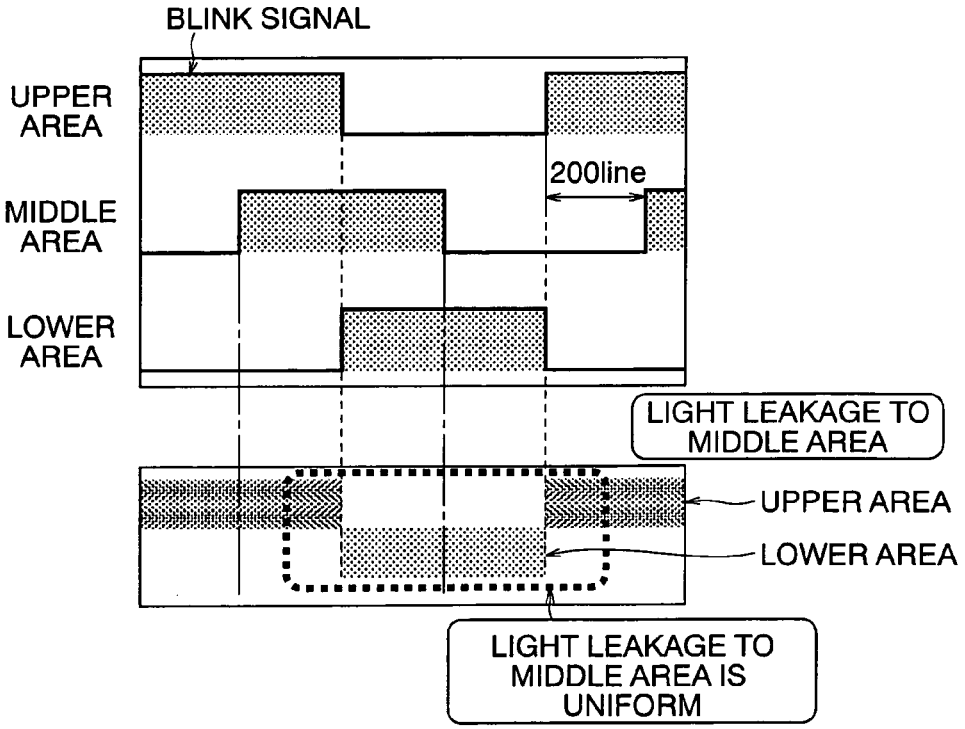

If, as shown in FIG. 10B, the blink timings of the cold cathode fluorescent lamps 2 are adjusted so that the lamp group facing the lower area of the screen turns on during the turn-off period of the lamp group facing the upper part of the screen, light from at least one of the lamp groups facing the upper and lower areas of the screen leaks to the middle area of the screen during the turn-on time of the lamp group facing the middle area. During the turn-off period of the lamp group facing the middle area of the screen, the light leakage to the middle area is from only one of the lamp groups facing the upper and lower areas and not from both.

The backlight drive sequence shown in FIG. 10B is a preferable method for driving the liquid crystal display of this embodiment.

Figure 11:
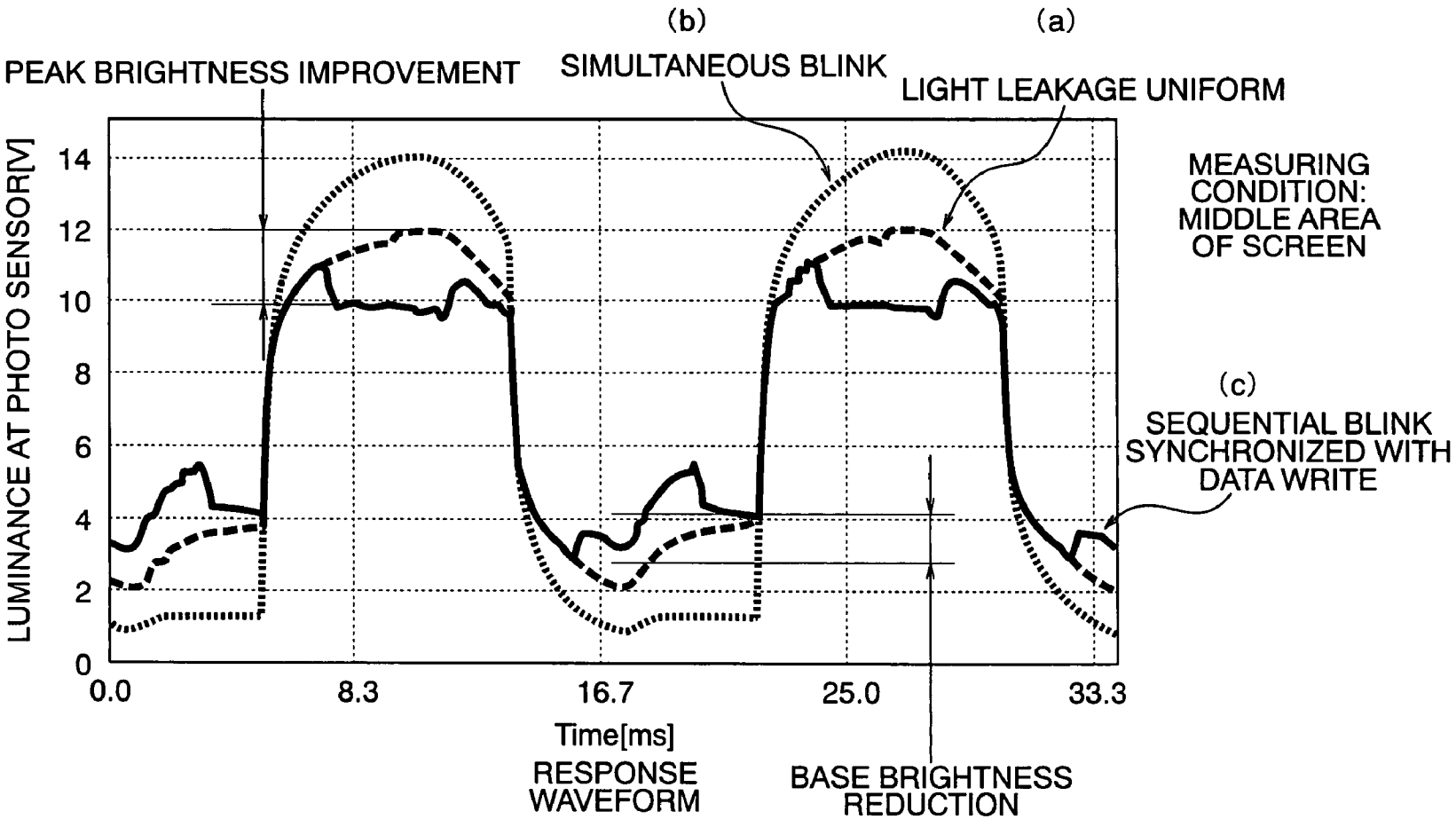
FIG. 11 illustrates brightness response waveforms for the cases of FIG. 10A and FIG. 10B.

The brightness response waveform measured in the middle area of the screen of the liquid crystal display of this embodiment whose backlight is driven by the sequence of FIG. 10B is shown at (a) in FIG. 11. FIG. 11 also shows for comparison a brightness response waveform (b) of the liquid crystal display whose backlight lamps are all driven simultaneously (FIG. 7) and a brightness response waveform (c) of the liquid crystal display whose backlight lamps are sequentially driven in synchronism with data write (FIG. 10A). The brightness response waveform of this embodiment, as shown in FIG. 11, has an improved peak brightness and a reduced base brightness compared with those when the backlight is sequentially blinked in synchronism with data write. The liquid crystal display driving method of this embodiment therefore can improve the motion picture performance and suppress the display brightness when compared to the display driving method using the backlight sequential blink synchronized with data write. Further, although the liquid crystal display driving method of this embodiment is not as good as the simultaneous blink method in terms of peak brightness and base brightness of the middle area of the screen, the brightness waveform produced by this driving method has a sufficient aspect ratio to maintain a pulse-like video illumination even in the middle area of the screen.

Figure 12A:
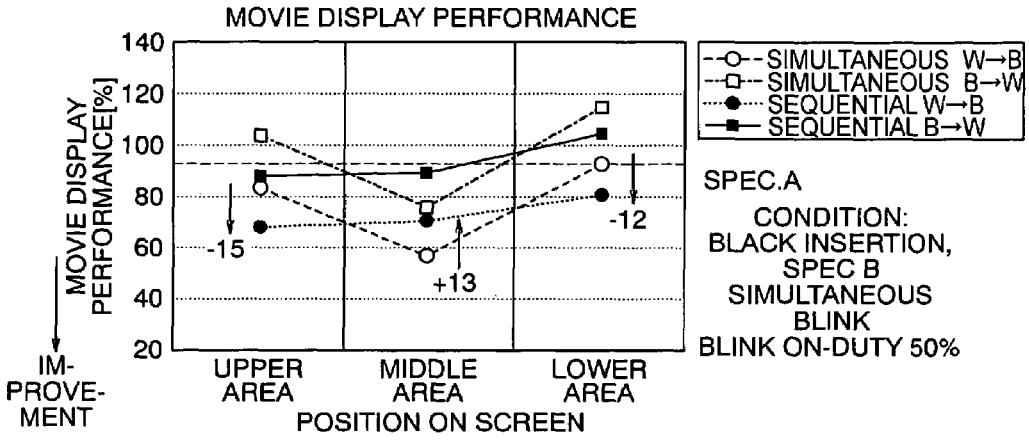
FIGS. 12A, 12B and 12C are graphs showing a motion picture performance, a brightness deterioration rate and a chromaticity variation of the liquid crystal display as one embodiment of this invention when light leakages from the upper and lower area of the screen are equalized by adjusting the upper and lower area blink timings.
Figure 12B:
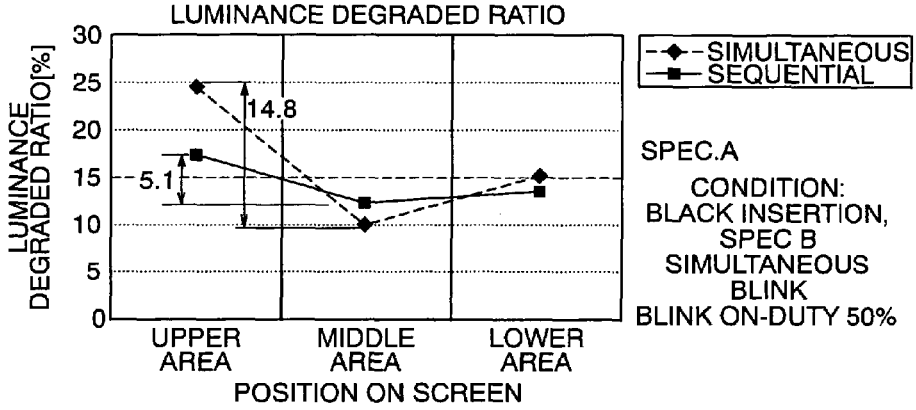
Figure 12C:
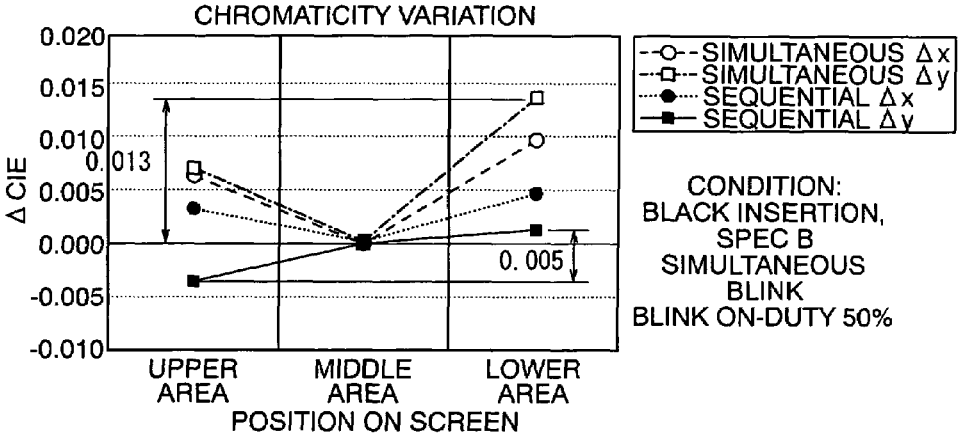

FIGS. 12A, 12B and 12C show comparisons between the liquid crystal display driving method of this embodiment and the driving method using the backlight simultaneous blink operation in terms of the motion picture performance, brightness deterioration rate and chromaticity variation in the upper, middle and lower areas of the screen.

FIG. 12A show a comparison in the motion picture performance. As for the motion picture performance, the liquid crystal display driving method of this embodiment (data indicated by black circles and black squares) produces a 15% improvement in the upper area of the screen and a 12% improvement in the lower area over the simultaneous blink operation (data indicated by white circles and white squares) as shown in FIG. 12A, although the motion picture performance in the middle area is 13% lower. In terms of video characteristic, therefore, the liquid crystal display driving method of this embodiment can be said to have practically reached the target level in the upper and middle areas of the screen.

FIG. 12B shows a brightness deterioration rate comparison. The liquid crystal display driving method of this embodiment (indicated by square marks) holds down the brightness deterioration rate to 17% in the upper area of the screen, compared with a much higher deterioration rate for the simultaneous blink operation (indicated by diamond marks), as shown in FIG. 12B. But no significant differences are observed in the brightness deterioration rate in the middle and lower areas of the screen. With the liquid crystal display driving method of this embodiment, however, it is possible to suppress the brightness deterioration rate in the middle and lower areas to a level lower than that of the simultaneous blink method by increasing the black insertion percentage. The brightness difference between the upper and lower areas of the screen, which is a problem with the simultaneous blink operation, can be reduced from 14.8% to 5.1%.

FIG. 12C shows a comparison of chromaticity variation. As shown in FIG. 12C, the maximum chromaticity variation of 0.013 produced by the simultaneous blink method (blank circles and blank squares) can be reduced to 0.005 with the driving method of this embodiment (solid circles and solid squares). This means that the target requirement is met.

As described above, the black-inserted, sequential blink method drives the backlight in such a manner that, during the turn-on period of light source group facing the middle area of the screen, at least one of light source groups facing the upper and lower areas of the screen is turned on and that, during the turn-off period of the light source group facing the middle area of the screen, the light source groups facing the upper and lower areas of the screen are prevented from getting turned on at the same time. This method can minimize a degradation of motion picture performance in the middle area of the screen and improve the motion picture performance and brightness characteristic in the upper and lower areas of the screen.

In the normal operation at fV=60 Hz, there is a data write timing difference between the uppermost part and the lowermost part of the screen.

With the screen divided into three parts, upper, middle and lower areas, the cold cathode fluorescent lamps 2 corresponding to the upper, middle and lower areas of the screen are blinked with a turn-on duty of 50%. In this case, the lamp group in the lower area of the screen turns on about 2 ms after the lamp group in the upper area turns off.

Thus, the lamp groups in the upper and lower areas of the screen stay turned on longer in the turn-off period of the lamp group in the middle area than in the turn-on period.

If only the lamp group in the upper or lower area of the screen is turned on, the light leaked from the upper and lower areas of the screen influences the middle area.

Since the motion picture performance of the middle area of the screen needs to be set in a best condition, an adjustment must be made to turn on the lamp group in the middle area at an optimum timing.

This adjustment alone, however, cannot prevent the pulse-like brightness waveform of the middle area of the screen from being deformed by the light leakage from the upper and lower areas, resulting in a degraded motion picture performance.

To deal with this problem, this embodiment matches the turn-on end time of the lamp group situated in the upper area of the screen to the turn-on start time of the lamp group situated in the lower area of the screen so that there is no gap between the turn-on period of the lamp group in the upper area and the turn-on period of the lamp group in the lower area, thereby minimizing the influence of the light leakage on the middle area of the screen and improving the characteristics of the upper and lower areas of the screen.

The aforesaid document mentioned in the section of BACKGROUND OF THE INVENTION discloses that the motion picture performance is improved by intermittently turning on the backlight in synchronism with a frame period. However, this document does not disclose a blink sequence such as that of this embodiment.

A liquid crystal display mounted on a television receiver is supplied video data at a frequency of 60 Hz. Thus, the liquid crystal display is normally driven at a vertical synchronization signal of fV=60 Hz. Therefore, there is a time difference of about 16 ms between a video signal input (data write) to the uppermost part of the screen (pixel row $Y_{001}$) and a video signal input (data write) to the lowermost part of the screen (pixel row $Y_{MAX}$ or, in WXGA-class, $Y_{768}$). With the screen divided into three parts, upper, middle and lower areas, if the cold cathode fluorescent lamp groups 2 situated in the upper, middle and lower areas of the screen are blinked with a turn-on duty of 50%, the lamp group in the lower area of the screen turns on about 2 ms after the lamp group in the upper area turns off. Thus, the lamp groups in the upper and lower areas of the screen stay turned on longer in the turn-off period of the lamp group in the middle area than in the turn-on period.

If only one of the lamp groups 2 in the upper and lower areas of the screen is turned on, the light leaked from these areas of the screen influences the quality of image displayed on the middle area. In displaying a moving image on a liquid crystal display, since the motion picture performance of the middle area of the screen needs to be set in a best condition, an adjustment must be made to turn on the lamp group in the middle area at an optimum timing. This adjustment alone, however, cannot prevent the pulse-like brightness waveform of the middle area of the screen from being deformed by the light leakage from the upper and lower areas, resulting in a degraded motion picture performance.

To deal with this problem, this embodiment matches the turn-on end time of the lamp group situated in the upper area of the screen to the turn-on start time of the lamp group situated in the lower area of the screen so that both of the lamp groups in the upper and lower areas of the screen will not be turned off at the same time during the turn-on period of the lamp group situated in the middle area of the screen. In other words, the backlight drive sequence is so set as to make sure that, in the turn-on period of the light source group in the middle area of the screen, there is no time gap between the turn-off time of the light source group facing the upper area of the screen and the turn-on time of the light source group facing the lower area of the screen. Considering the essence of this invention, only during the turn-on period of the light source group facing the middle area of the screen, is it possible to overlap the turn-on period of the light source group facing the upper area over the turn-on period of the light source group facing the lower area. The light entering into the middle area of the screen from the surrounding during the turn-on period of the light source group facing the middle area enhances the peak brightness of the middle area. However, in light of the improvement of the motion picture performance and the suppression of the brightness degradation in the upper and lower areas of the screen, which is the intended object of the light source groups facing the upper and lower areas of the screen, the duration in the turn-on period of the light source group facing the middle area of the screen in which these turn-on periods overlap each other is limited.

In the light source turn-on operation of this embodiment described above, in the turn-off period of the light source group facing the middle area of the screen, it is important to avoid overlapping the turn-on period of the light source group facing the upper area of the screen and the turn-on period of the light source group facing the lower area of the screen to suppress the base brightness in the middle area of the screen. This minimizes the effect that the light source groups in the upper and lower areas have on the image display in the middle area, thus improving the image display characteristics of the upper and lower areas.

In the above mentioned document teaches there is a description in that the motion picture performance is improved by intermittently turning on the backlight in synchronism with a frame period. However, this reference does not disclose a blink sequence such as that of this embodiment.

Figure 23:
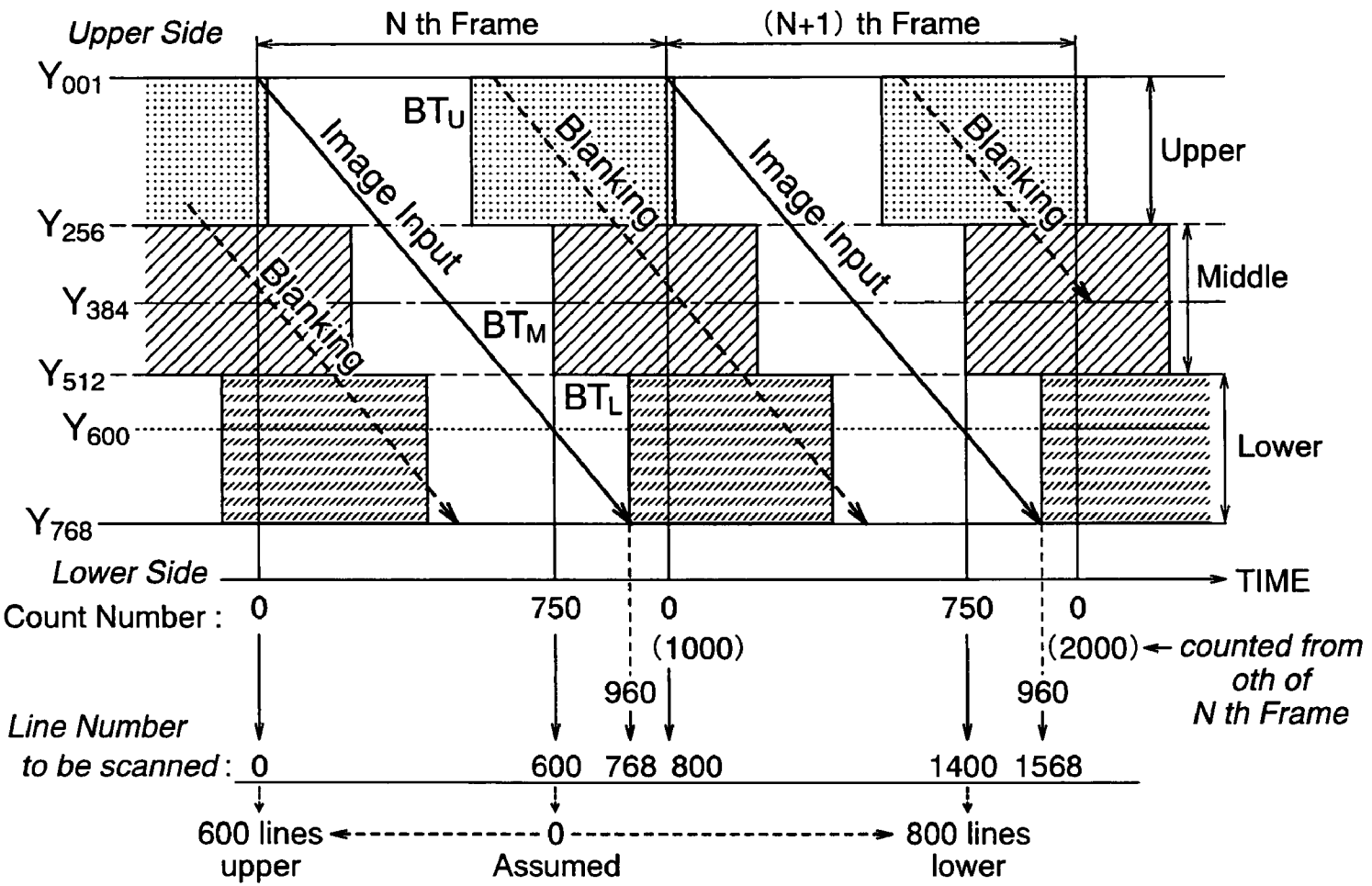
FIG. 23 is a signal diagram showing a backlight drive sequence in the embodiment of this invention superimposed on the liquid crystal display panel drive sequence of FIG. 22 with the black insertion percentage of 42%.

FIG. 23 shows a backlight drive sequence of this embodiment superimposed on the liquid crystal display panel drive sequence of FIG. 22 with the black insertion percentage of 42%. The abscissa in FIG. 23 represents a time axis and pixel rows (scan lines) to be vertically scanned are arranged along the ordinate in the order of address. The liquid crystal display panel on which 768 pixel rows $Y_{001}$-$Y_{768}$ are arranged is divided into three areas—an upper area in which pixel rows $Y_{001}$-$Y_{256}$ are arranged, a middle area in which pixel rows $Y_{257}$-$Y_{512}$ are arranged, and a lower area in which pixel rows $Y_{513}$-$Y_{768}$ are arranged. The three areas of the screen are opposed by an upper light source group (fluorescent lamps Lamp 1-Lamp 4), a middle light source group (fluorescent lamps Lamp 5-Lamp 8) and a lower light source group (fluorescent lamps Lamp 9-Lamp 12).

The upper light source group performs a so-called blink operation in which its lamps are turned on during a shaded period of a row corresponding to the upper area of the screen of FIG. 23 and turned off during other periods. The middle light source group is turned on during a shaded period of a row corresponding to the middle area of the screen of FIG. 23 and turned off during other periods. The lower light source group is turned on during a shaded period of a row corresponding to the lower area of the screen of FIG. 23 and turned off during other periods. For example, in an Nth frame period the upper, middle and lower light source groups begin to turn on in response to and in the order of the vertical scan that inputs video signals to the associated pixel rows. Thus, the blink timings for the upper, middle and lower light source groups, $BT_U$, $BT_M$, $BT_L$, are points in time representing the left ends of the turn-on periods of the upper, middle and lower light source groups.

This backlight drive sequence sets the blink timings $BT_U$, $BT_M$, $BT_L$ so that the turn-on period of the upper light source group and the turn-on period of the lower light source group overlap each other in the turn-on period of the middle light source group. The middle light source group, which constitutes a reference in this drive sequence, begins to be turned on at a scan line number of line 600, which is a predetermined time $t_M$ after the video signal input to the pixel rows in the middle area of the screen is finished. The upper light source group begins to be turned on a predetermined time $t_U$ ($t_U > t_M$) after the video signal input to the pixel rows in the upper area of the screen is finished. The lower light source group begins to be turned on a predetermined time $t_L$ ($t_M > t_L$) after the video signal input to the pixel rows in the lower area of the screen is finished. These light source groups are sequentially blinked with a turn-on duty of 50% with respect to the frame period. Therefore, in the turn-off period of the middle light source group, either only one of the upper and lower light source groups is turned on or both of them are turned off.

Based on the fact that the liquid crystal layer produces a delayed response to video signals and blanking signals, the backlight drive sequence shown in FIG. 23 delays the blink timings $BT_U$, $BT_M$, $BT_L$ for the light source groups from the video signal input start timings for the associated pixel rows and starts inputting blanking signals to the associated pixel rows while the respective light source groups are still turned on. Therefore, at the upper end of the screen (pixel row $Y_{001}$) the timing at which the upper light source group begins to be turned on in response to the video signal input is delayed and the blanking signal is input while the upper light source group is still turned on. At the lower end of the screen (pixel row $Y_{768}$), the lower light source group is turned off before the light transmissivity of the liquid crystal layer reaches a value corresponding to the video signal. As a result, the image becomes somewhat dark at the upper and lower ends of the screen but only to an extent that does not affect the quality of displayed image as a whole. This also enhances the peak brightness and suppresses the base brightness in the middle area of the screen.

If the 12 fluorescent lamps shown in FIG. 20 (FIG. 19) are divided into six light source groups of two fluorescent lamps each, two light source groups (a light source group including Lamps 5 and 6 and a light source group including Lamps 7 and 8) facing a central area of the screen are regarded as a middle light source group and two light source groups each on the upper and lower side of the middle light source group are regarded as an upper light source group and a lower light source group, respectively. The turn-on periods of these upper and lower light source groups are adjusted. Such an adjustment of the turn-on period is also made when the 12 fluorescent lamps are divided into four light source groups of three lamps each. Thus, the liquid crystal display with a backlight facing the liquid crystal display panel screen and comprising n (n is a natural number; $n \geqq 3$) light sources, that are arrayed in the scan direction and extend in a direction crossing the scan direction, is driven as follows in this embodiment.

(1) The n light sources arrayed in the vertical scan direction of the liquid crystal display panel are sequentially turned on, beginning with the light sources provided in the upper area of the backlight, in response to the sequential input of video signals into the horizontal pixel rows arrayed in the vertical scan direction (i.e., in response to the sequential selection of scan lines).

(2) The n light sources are divided into a first light source group facing the middle area of the liquid crystal display panel and a second and a third light source group immediately on the upper and lower side of the first light source group. In a frame period in which video signals are input to the pixel rows of the liquid crystal display panel, the second, first and third light source group are turned on in that order and turned off in the same order.

(3) The turn-on period of the second light source group in the frame period ends while the first light source group is still turned on, and the turn-on period of the first light source group ends while the third light source group is still on. That is, the turn-on period of the first light source group overlaps with the turn-on periods of the second and third light source groups on the time axis.

(4) The third light source group begins to be turned on during the turn-on period of the first light source group when or before the turn-on period of the second light source group ends.

Figure 13A:
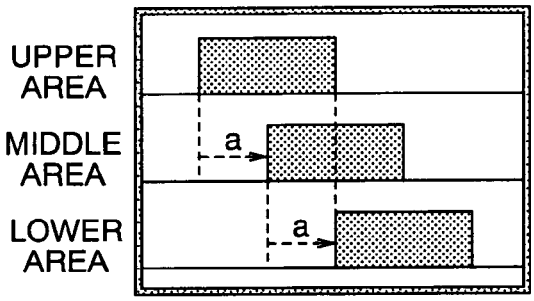
FIGS. 13A, 13B and 13C are diagrams showing variations of the embodiment with different sequential blink timings.
Figure 13B:
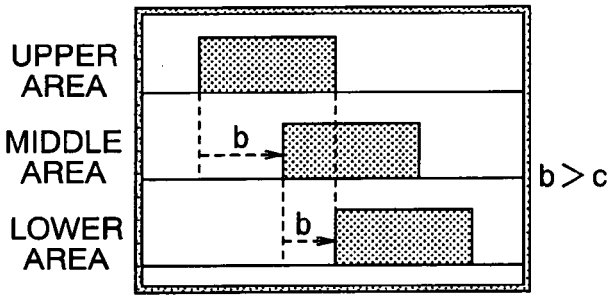
Figure 13C:
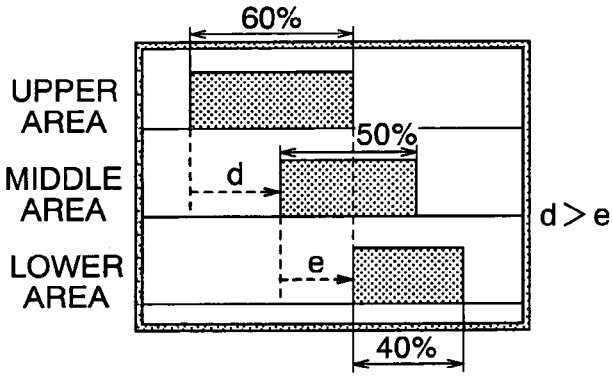
Figure 15A:
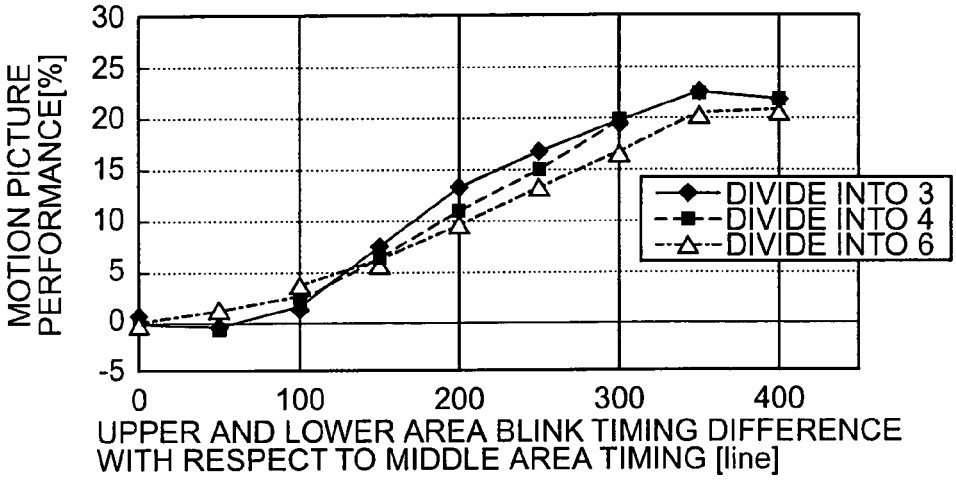
FIGS. 15A, 15B, 15C, 15D, 15E and 15F are graphs showing motion picture performances when the upper and lower area blink timings are changed with the middle area blink timing taken as a reference in the state of FIG. 14.
Figure 15B:
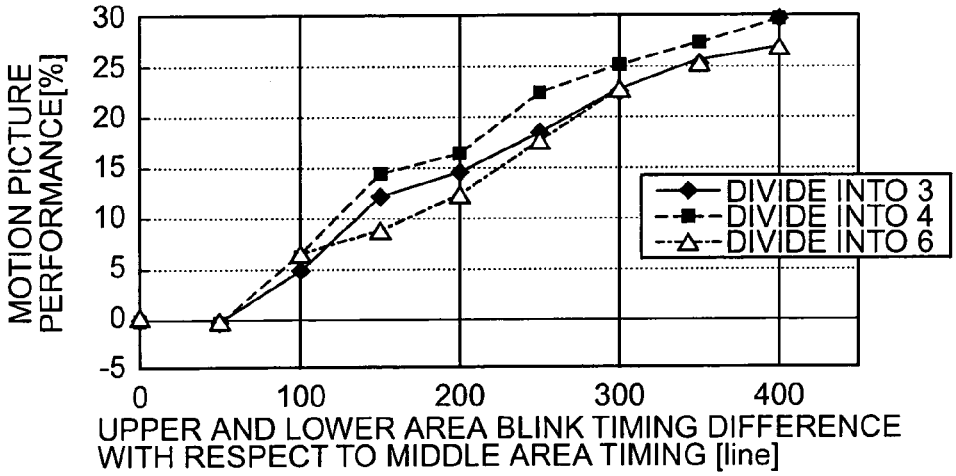
Figure 15C:
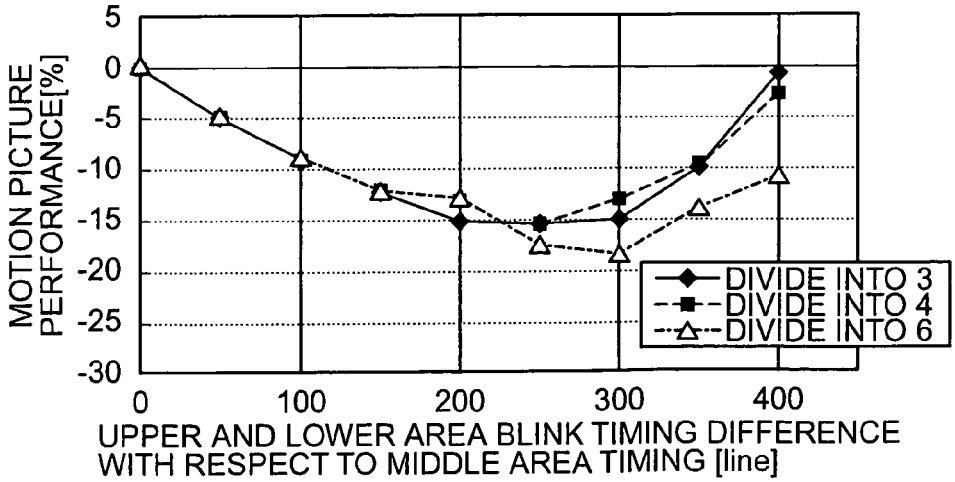
Figure 15D:
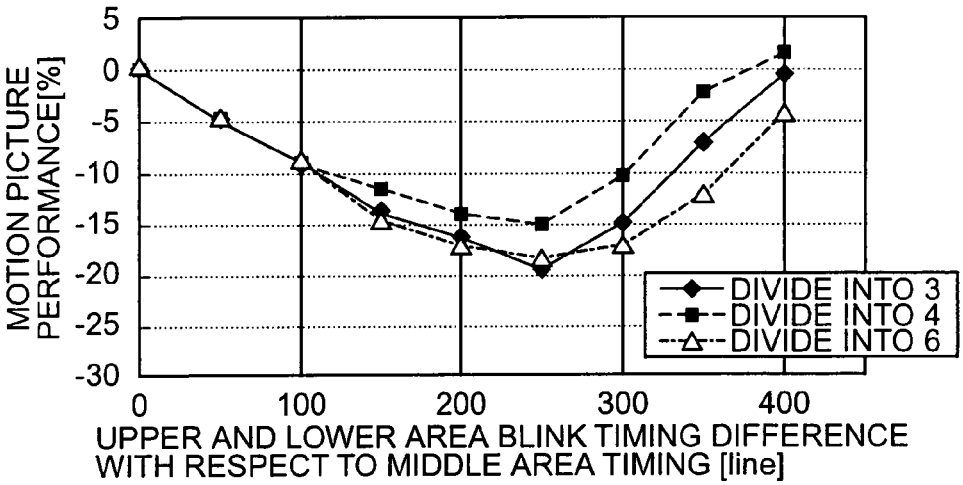
Figure 15E:
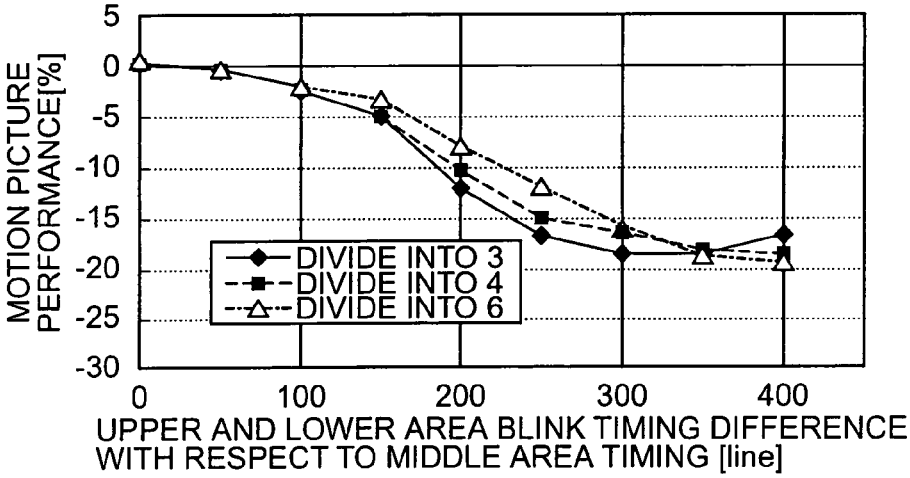
Figure 15F:
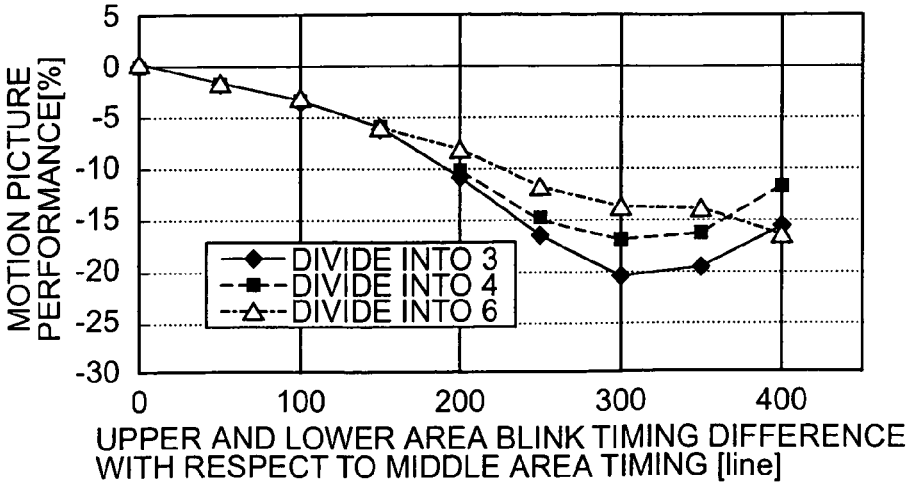

FIGS. 13A, 13B and 13C show other sequential blink timings as variations of this embodiment. Hatched rectangular waves represent turn-on periods.

FIG. 13A shows a sequential blink similar to the one described above, in which the blink intervals (and turn-on periods) are constant.

If the group of cold cathode fluorescent lamps 2 situated in the upper area of the screen and the lamp group in the lower area are turned on so that their turn-on periods are not separated by a time gap, it is possible to shift the turn-on timing of the middle lamp group, as shown in FIG. 13B, because the light leakage to the middle area of the screen is uniform.

As shown in FIG. 12B, the brightness of the upper area of the screen is degraded, when compared to those of the middle and lower areas. This can be remedied by advancing the blink timing (turn-on start time) of the lamp group in the upper area to some extent.

Further, by advancing the blink timing (turn-on start time) of the lamp group in the lower area of the screen and turning on the lamp groups in the upper and lower areas so that their turn-on periods are not separated by a time gap, the brightness gradients of the upper, middle and lower areas of the screen can be adjusted while maintaining the characteristic of the middle area.

While in the above explanation the blink on-duty is set constant, it is possible to change the blink on-duty (turn-on period) of the lamp group in the upper area of the screen relative to the blink on-duty (turn-on period) of the lamp group in the lower area, as shown in FIG. 13C, to obtain the same brightness adjustment effects as shown in FIG. 13B. Adjustments can also be made by giving the motion picture performance a priority over the brightness.

As described above, where a plurality of cold cathode fluorescent lamps 2 of the direct-type backlight are divided into three groups and the lamp groups are sequentially turned on intermittently in one frame period, this embodiment turns on the lamp groups in the upper and lower areas of the screen so that their turn-on periods are not separated by a time gap. This can minimize a degradation of the motion picture performance of the middle area caused by light leakage from the upper and lower areas and reduce the brightness gradients and chromaticity variations on the screen.

In this embodiment, the lamp groups in the upper and lower areas of the screen may be turned on so that their turn-on periods are not separated by a time gap. This can be achieved by setting the turn-on start time of the lamp group in the lower area at a point in time after the turn-on start time of the lamp group in the upper area but before the turn-on end time of the upper area lamp group (i.e., the turn-on start time of the lower area lamp group falls in the turn-on period of the upper area lamp group).

By combining the black insertion with the sequential blink operation, it is possible to produce a pulse-like video illumination such as found in CRT and improve the motion picture performance.

While an example case has been described in which a plurality of cold cathode fluorescent lamps 2 of the direct-type backlight is divided into three group and in which these lamp groups are sequentially turned on intermittently, the present invention is not limited to this case and the number of groups, n, into which the lamps of the direct-type backlight are divided may be three or more.

FIGS. 15A, 15B, 15C, 15D, 15E and 15F show motion picture performances when the lamps of the direct-type backlight are divided into four and six groups and these lamp groups are sequentially driven, as shown in FIGS. 14A, 14B and 14C.

As shown in these figures, the cold cathode fluorescent lamps 2 of the direct-type backlight, if divided into four and six groups, produce almost the same effect as when they are divided into three groups.

Thus, if the number of groups into which the lamps of the direct-type backlight are divided is increased, the only requirement is to turn on these lamp groups so that the turn-on periods of uppermost and lowermost lamp groups are not separated by a time gap, the lamp groups being determined as uppermost and lowermost when viewed in a direction in which display lines are selected to write video signal voltages into pixel rows of the liquid crystal display panel 5.

The invention accomplished by the inventor has been described in detail by taking up example cases. It is noted that the invention is not limited to the above embodiments and that various modifications may be made without departing from the spirit of the invention.

The effects and advantages produced by the representative one of inventions disclosed in this application may be briefly summarized as follows.

This invention can improve the motion picture performance without degrading the brightness.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A method of driving a liquid crystal display, wherein the liquid crystal display comprises a liquid crystal display panel and an illuminating device;

wherein the liquid crystal display panel has a matrix of a plurality of pixels arrayed two-dimensionally in a first direction and in a second direction crossing the first direction, and in the pixel matrix a plurality of pixel rows each made up of a group of pixels lined in the second direction are arrayed in the first direction and sequentially selected in each frame period from one end of the pixel matrix to the other end;

wherein the illuminating device has a plurality of light sources facing the pixel matrix of the liquid crystal display panel and the plurality of light sources are arrayed in the first direction and divided into at least three light source areas facing at least three groups of pixel rows;

wherein turn-on periods of the light source areas sequentially start in the each frame period when one of the at least three groups of pixel rows corresponding to the at least three light source areas is selected and the plurality of pixels belonging to the selected group of pixel rows begin to receive video signals;

wherein the turn-on periods of the light source areas sequentially ends in the each frame period;

wherein the at least three light source areas are a first light source area, a second light source area and a third light source area, the first light source area facing a middle area, with respect to the first direction, of the pixel matrix where a first group of the pixel rows is situated, the second light source area facing an area of the pixel matrix adjoining the middle area in the first direction where a second group of the pixel rows is situated which is selected before the first group of the pixel rows in the each frame period, the third light source area facing another area of the pixel matrix adjoining the middle area in the first direction where a third group of the pixel rows is situated which is selected after the first group of the pixel rows in the each frame period;

wherein the turn-on period of the second light source area, the turn-on period of the first light source area and the turn-on period of the third light source area are sequentially start and end in that order;

wherein the turn-on period of the second light source area ends after the turn-on period of the first light source area has started;

wherein the turn-on period of the third light source area starts after the turn-on period of the first light source area has started and when or before the turn-on period of the second light source area ends.

2. A liquid crystal display driving method according to claim 1, wherein a start time of the turn-on period of the third light source area coincides with an end time of the turn-on period of the second light source area.

3. A liquid crystal display driving method according to claim 1, wherein the turn-on periods of the first light source area, the second light source area and the third light source area in the frame period are equal.

4. A liquid crystal display driving method according to claim 1, wherein one of the turn-on periods of the first light source area, the second light source area and the third light source area in the frame period differs from at least one of the others.

5. A liquid crystal display driving method according to claim 4, wherein the turn-on periods of the first light source area, the second light source area and the third light source area in the frame period differ from each other.

6. A liquid crystal display driving method according to claim 1, wherein each of the plurality of light sources is a tube-like light source extending in the second direction and the illuminating device comprises the tube-like light sources arrayed in the first direction.

7. A liquid crystal display driving method according to claim 6, wherein a plurality of the tube-like light sources are arrayed in the first direction in at least one of the first light source area, the second light source area and the third light source area.

8. A liquid crystal display driving method according to claim 1, wherein the plurality of pixels belonging to the first group of pixel rows, the plurality of pixels belonging to the second group of pixel rows and the plurality of pixels belonging to the third group of pixel rows oppose the first light source area, the second light source area and the third light source area, respectively.

9. A liquid crystal display driving method according to claim 1, wherein the first light source area, the second light source area and the third light source area are arrayed in that order from the one end of the pixel matrix to the other end.

10. A liquid crystal display driving method according to claim 1, wherein in the frame period the plurality of pixel rows, after having received the video signals, are selected again to have brightness reducing voltage signals supplied to the plurality of pixels belonging to the re-selected pixel rows.

11. A liquid crystal display driving method according to claim 10, wherein the voltage signals display in black the plurality of pixels belonging to the re-selected pixel rows.

12. A liquid crystal display driving method according to claim 1, wherein a period from a point in time at which the video signals begin to be taken into the second group of pixel rows to a point in time at which the turn-on period of the second light source area begins differs from a period from a point in time at which the video signals begin to be taken into the first group of pixel rows to a point in time at which the turn-on period of the first light source area begins.

13. A liquid crystal display driving method according to claim 1, wherein a period from a point in time at which the video signals begin to be taken into the third group of pixel rows to a point in time at which the turn-on period of the third light source area begins differs from a period from a point in time at which the video signals begin to be taken into the first group of pixel rows to a point in time at which the turn-on period of the first light source area begins.

14. A method of driving a liquid crystal display, wherein the liquid crystal display comprises:

a liquid crystal display panel having a matrix of a plurality of pixels arrayed two-dimensionally in a first direction and in a second direction crossing the first direction;

a plurality of pixel rows each made up of a group of the pixels lined in the second direction, the pixel rows being arrayed in the first direction in the pixel matrix and sequentially selected in each frame period from one end of the pixel matrix to the other end; and an illuminating device having a plurality of light sources facing the pixel matrix of the liquid crystal display panel, the plurality of light sources being arrayed in the first direction and divided into at least three light source areas facing at least three groups of pixel rows;

the liquid crystal display driving method repeating in each frame period the steps of:

sequentially starting turn-on periods of the light source areas when one of the at least three groups of pixel rows corresponding to the at least three light source areas is selected and the plurality of pixels belonging to the selected group of pixel rows begin to receive video signals;

after the turn-on periods of the at least three light source areas corresponding to the at least three groups of pixel rows have started, sequentially selecting again one of the at least three groups of pixel rows to put blanking signals for blanking the video signals into the re-selected group of pixel rows; and ending the turn-on periods of the at least three light source areas after one of the at least three groups of pixel rows has started to receive the blanking signals;

wherein the at least three light source areas are divided into (i) a first light source area facing a middle area, with respect to the first direction, of the pixel matrix where a first group of the pixel rows is situated, (ii) a second light source area facing an area of the pixel matrix adjoining the middle area in the first direction where a second group of the pixel rows is situated which receives the video signals before the first group of the pixel rows in the each frame period, and (iii) a third light source area facing another area of the pixel matrix adjoining the middle area in the first direction where a third group of the pixel rows is situated which receives the video signals after the first group of the pixel rows in the each frame period;

wherein the turn-on period of the second light source area, the turn-on period of the first light source area and the turn-on period of the third light source area sequentially start and end in that order;

wherein the turn-on period of the second light source area ends after the turn-on period of the first light source area has started;

wherein the turn-on period of the third light source area starts after the turn-on period of the first light source area has started and when or before the turn-on period of the second light source area ends;

wherein, after the turn-on period of the first light source area has ended in the each frame period before the turn-on period of the first light source area starts in a next frame period, at least one of the turn-on periods of the second light source area and the third light source area is suspended.

15. A liquid crystal display comprising:

a liquid crystal display panel having a matrix of a plurality of pixels arrayed two-dimensionally in a first direction and in a second direction crossing the first direction, the pixel matrix having a plurality of pixel rows each made up of a group of pixels lined in the second direction, the pixel rows being arrayed in the first direction and sequentially selected in each frame period from one end of the pixel matrix to the other end;

an illuminating device having a plurality of light sources facing the pixel matrix of the liquid crystal display panel, the plurality of light sources being arrayed in the first direction and divided into at least three light source areas facing at least three groups of pixel rows; and a control unit including a display control circuit to give video signals to the pixel matrix and a light source driving circuit to control the driving of the plurality of light sources in response to a control signal from the display control circuit;

wherein the control unit executes the following steps of:

sequentially starting in the each frame period turn-on periods of the light source areas when one of the at least three groups of pixel rows corresponding to the at least three light source areas is selected and the plurality of pixels belonging to the selected group of pixel rows begin to receive video signals;

sequentially ending the turn-on periods of the light source areas in the each frame period;

using the at least three light source areas as a first light source area, a second light source area and a third light source area, the first light source area facing a middle area, with respect to the first direction, of the pixel matrix where a first group of the pixel rows is situated, the second light source area facing an area of the pixel matrix adjoining the middle area in the first direction where a second group of the pixel rows is situated which is selected before the first group of the pixel rows in the each frame period, the third light source area facing another area of the pixel matrix adjoining the middle area in the first direction where a third group of the pixel rows is situated which is selected after the first group of the pixel rows in the each frame period;

sequentially starting and ending the turn-on period of the second light source area, the turn-on period of the first light source area and the turn-on period of the third light source area in that order;

ending the turn-on period of the second light source area after the turn-on period of the first light source area has started; and starting the turn-on period of the third light source area after the turn-on period of the first light source area has started and when or before the turn-on period of the second light source area ends.

* * * * *